US012098015B2

(12) United States Patent
Esse et al.

(10) Patent No.: US 12,098,015 B2
(45) Date of Patent: Sep. 24, 2024

(54) DEVICE FOR CONTROLLING HEADSPACE HUMIDITY AND METHODS FOR MAKING THE SAME

(71) Applicant: Boveda Inc., Minnetonka, MN (US)

(72) Inventors: Robert L. Esse, Monticello, MN (US); Brian Rice, Greenfield, MN (US)

(73) Assignee: Boveda Inc., Minnetonka, MN (US)

( * ) Notice: Subject to any disclaimer, the term of this patent is extended or adjusted under 35 U.S.C. 154(b) by 0 days.

(21) Appl. No.: 16/780,968

(22) Filed: Feb. 4, 2020

(65) Prior Publication Data

US 2020/0207534 A1 Jul. 2, 2020

Related U.S. Application Data

(63) Continuation-in-part of application No. 15/782,363, filed on Oct. 12, 2017.

(60) Provisional application No. 62/407,269, filed on Oct. 12, 2016.

(51) Int. Cl.
*B65B 31/00* (2006.01)
*B65D 81/26* (2006.01)

(52) U.S. Cl.
CPC ..... *B65D 81/268* (2013.01); *B65B 31/00* (2013.01)

(58) Field of Classification Search
USPC ..... 53/400
See application file for complete search history.

(56) References Cited

U.S. PATENT DOCUMENTS 339,492 A 4/1886 Smith
1,241,695 A 10/1914 Alexander
1,222,656 A 4/1917 Moyer
1,268,135 A 6/1918 McElroy
1,425,790 A 8/1922 Moyer
1,481,971 A 1/1924 Whiting
1,556,951 A 10/1925 Marshall
1,841,889 A 1/1932 Grunwald
1,866,560 A 7/1932 Gordon et al.
1,871,418 A 8/1932 McKee
1,871,419 A 8/1932 McKee
1,967,554 A 7/1934 Gross et al.
(Continued)

FOREIGN PATENT DOCUMENTS

CH 667514 10/1988
CN 101128891 2/2008
(Continued)

OTHER PUBLICATIONS

Office Action issued Jun. 29, 2018 in U.S. Appl. No. 15/978,713 by Biesecker Longacre.
Ageless® Oxygen Absorber Instruction Manual, Mitsubishi Gas Chemical Company, Inc., May 2011 (32 pages).
(Continued)

*Primary Examiner* — Chinyere J Rushing-Tucker
(74) *Attorney, Agent, or Firm* — Padda Law Group

(57) ABSTRACT

Humidity controlled product methods and packages produced by providing a package material having an interior surface and providing a plurality of humidity control devices in a continuous strip, separating a humidity control device from the strip, adhering the humidity control device to the interior surface of the product package material, and forming the package material into a product package or a product package component with the separated humidity control device adhered to an interior space within the package.

7 Claims, 16 Drawing Sheets

(56) References Cited

U.S. PATENT DOCUMENTS 1,972,118 A 9/1934 McDill
1,998,683 A 4/1935 Montgomery
2,080,402 A 5/1937 Herman
2,085,600 A 6/1937 Petersen
2,169,055 A 8/1939 Overshiner
2,227,158 A 12/1940 Saul
2,236,024 A 3/1941 Tyler
2,270,603 A 1/1942 Ridder
2,300,041 A 10/1942 Samuel
2,329,908 A 9/1943 Johnson
2,365,185 A 12/1944 Gailey
2,368,140 A 1/1945 Johnson
2,452,957 A 11/1948 Sabin
2,458,695 A 1/1949 Edelston
2,545,710 A 3/1951 Snyder
2,758,932 A 8/1956 Scott
2,807,514 A 9/1957 Williams
3,135,566 A 6/1964 Charles
3,204,388 A 9/1965 Asker
3,211,503 A 10/1965 Barnes
3,254,784 A 6/1966 Lancesseur
3,315,447 A 4/1967 Meier
3,419,400 A 12/1968 Hayhurst
3,567,085 A 3/1971 Flores
3,578,545 A 5/1971 Carson et al.
3,719,033 A 3/1973 Den Boer
3,722,188 A 3/1973 Cullen
3,785,556 A 1/1974 Watkins
3,801,011 A 4/1974 Guehler et al.
3,815,828 A 6/1974 Engel
3,820,309 A 6/1974 Cullen et al.
3,897,226 A 7/1975 Doherty
3,990,872 A 11/1976 Cullen
4,027,068 A 5/1977 Saad
4,091,930 A 5/1978 Buchner
4,127,503 A 11/1978 Yoshikawa et al.
4,145,001 A 3/1979 Weyenberg et al.
4,146,277 A 3/1979 Santoro
4,150,372 A 4/1979 Foote
4,158,440 A 6/1979 Sullivan et al.
4,161,283 A 7/1979 Hyman
4,192,773 A 3/1980 Yoshikawa et al.
4,223,070 A 9/1980 Hahn et al.
4,279,350 A 7/1981 King
4,285,468 A 8/1981 Hyman
4,287,995 A 9/1981 Moriya
4,384,972 A 5/1983 Nakamura et al.
4,406,843 A 9/1983 Nakamura et al.
4,421,235 A 12/1983 Moriya
4,423,080 A 12/1983 Bedrosian et al.
4,445,641 A 5/1984 Baker et al.
4,524,015 A 6/1985 Takahashi et al.
4,528,228 A 7/1985 Clevenger
4,572,051 A 2/1986 Laskin
4,594,082 A 6/1986 Catherwood, Sr.
4,614,528 A 9/1986 Lennen
4,615,923 A 10/1986 Marx
4,645,698 A 2/1987 Matsubara
4,649,793 A 3/1987 Blackshear et al.
4,686,776 A 8/1987 Matsubara
RE32,513 E 10/1987 Seaber et al.
4,749,392 A 6/1988 Aoki et al.
4,756,436 A 7/1988 Morita
4,756,726 A 7/1988 Peace
4,772,300 A 9/1988 Cullen et al.
4,783,206 A 11/1988 Cullen et al.
4,813,791 A 3/1989 Cullen
4,822,500 A 4/1989 Dobson, Jr. et al.
4,834,234 A 5/1989 Sacherer et al.
4,840,280 A 6/1989 Schvester
4,891,141 A 1/1990 Christensen et al.
4,903,827 A 2/1990 Phelps et al.
4,923,059 A 5/1990 Evers et al.
4,934,524 A 6/1990 St. Charles
4,997,082 A 3/1991 Dorocher
5,019,212 A 5/1991 Morita et al.
5,035,731 A 7/1991 Spruill et al.
5,037,459 A * 8/1991 Spruill ..... B65D 81/24 206/0.7
5,096,724 A 3/1992 Zenner
5,114,003 A 5/1992 Jackisch et al.
5,130,018 A 7/1992 Tolman et al.
5,135,787 A 8/1992 Bair
5,219,075 A 6/1993 White
5,224,383 A 7/1993 Williams
5,284,871 A 2/1994 Graf
5,289,751 A 3/1994 Light
5,378,428 A 1/1995 Inoue et al.
5,390,475 A * 2/1995 Iwauchi ..... B65B 15/04 53/155
5,641,425 A 6/1997 McKedy et al.
5,698,217 A 12/1997 Wilking
5,773,105 A 6/1998 Klett
5,846,450 A 12/1998 Atkinson
5,885,481 A 3/1999 Venkateshwaran et al.
5,934,458 A 8/1999 Duron
5,934,773 A 8/1999 Ferrell
5,936,178 A 8/1999 Saari
5,944,306 A 8/1999 Maeda
5,975,288 A 11/1999 Crowder
5,977,212 A 11/1999 Ebner et al.
6,041,575 A * 3/2000 Vonderhorst ..... B65B 51/303 53/157
6,119,855 A 9/2000 Yeager
6,139,935 A 10/2000 Cullen et al.
6,156,421 A 12/2000 Stopper
6,158,580 A 12/2000 Davis
6,244,432 B1 6/2001 Saari et al.
6,274,209 B1 8/2001 Pagidas et al.
6,436,872 B2 8/2002 McKedy
6,508,955 B1 1/2003 DelDuca et al.
6,514,321 B1 2/2003 Lehto et al.
6,571,942 B2 6/2003 Riemenschneider et al.
6,620,992 B1 9/2003 Kinnaird
6,646,121 B2 11/2003 El Kabbani et al.
6,666,988 B2 12/2003 DelDuca et al.
6,740,145 B2 5/2004 Boroson et al.
6,921,026 B2 7/2005 Saari et al.
6,926,846 B1 8/2005 DelDuca et al.
6,932,267 B2 8/2005 Potenza
6,986,807 B2 1/2006 Brunk
7,147,799 B2 12/2006 DelDuca et al.
7,475,773 B2 1/2009 Lancesseur et al.
8,033,391 B1 10/2011 D'Abusco
8,048,201 B2 11/2011 Dukes et al.
8,087,645 B2 1/2012 Hepple
8,211,209 B2 7/2012 Neff
8,220,782 B2 7/2012 Hepple
8,528,469 B2 9/2013 Doglioni Majer
8,590,719 B2 11/2013 Sprishen et al.
8,748,723 B1 6/2014 Egberg et al.
8,771,770 B1 7/2014 Crump
9,616,382 B2 4/2017 Glorioso et al.
9,750,811 B2 9/2017 Egberg et al.
10,081,465 B2 9/2018 Biesecker Longacre
10,220,992 B2 3/2019 Biesecker Longacre et al.
2003/0029739 A1 2/2003 Riemenschneider et al.
2003/0203081 A1 10/2003 Saari et al.
2004/0022676 A1 2/2004 Hamilton et al.
2004/0045969 A1 3/2004 Chiang
2004/0198611 A1 10/2004 Atkinson et al.
2004/0224144 A1 11/2004 Saari et al.
2005/0172814 A1 8/2005 Brunk
2006/0097223 A1 5/2006 Powers et al.
2006/0144726 A1 7/2006 Foust
2007/0014686 A1 1/2007 Arnold et al.
2007/0114140 A1 5/2007 Portier
2008/0012172 A1 1/2008 Merical et al.
2008/0178559 A1* 7/2008 DeFedericis ..... B65B 41/18 53/469
2008/0314772 A1 12/2008 Saari et al.
2010/0221393 A1 9/2010 Lim et al.
2010/0304357 A1 12/2010 Meyers et al.
2011/0017615 A1 1/2011 Logel et al.

(56) References Cited

U.S. PATENT DOCUMENTS

| | | | |
|---|---|---|---|
| 2011/0079525 | A1 | 4/2011 | Peck et al. |
| 2011/0221393 | A1 | 9/2011 | Billmaier |
| 2011/0253232 | A1 | 10/2011 | Seline et al. |
| 2012/0020833 | A1 | 1/2012 | Cook et al. |
| 2013/0056369 | A1 | 3/2013 | Jorgensen |
| 2013/0153445 | A1 | 6/2013 | Cullison |
| 2013/0334074 | A1 | 12/2013 | Wada et al. |
| 2014/0209488 | A1 | 7/2014 | Dai |
| 2014/0270581 | A1 | 9/2014 | Jons |
| 2014/0339106 | A1 | 11/2014 | Schanin et al. |
| 2015/0053579 | A1 | 2/2015 | Lebon et al. |
| 2015/0136618 | A1 | 5/2015 | Patel et al. |
| 2015/0201673 | A1 | 7/2015 | Houmani |
| 2015/0259115 | A1 | 9/2015 | Yeh |
| 2015/0328584 | A1 | 11/2015 | Egberg et al. |
| 2016/0031627 | A1 | 2/2016 | Yeh |
| 2017/0225867 | A1 | 8/2017 | Dasgupta et al. |
| 2018/0099797 | A1 | 4/2018 | Biesecker Longacre et al. |
| 2018/0099804 | A1 | 4/2018 | Biesecker Longacre et al. |
| 2018/0257830 | A1 | 9/2018 | Biesecker Longacre et al. |
| 2019/0002140 | A1 | 1/2019 | Riley et al. |
| 2019/0177058 | A1 | 6/2019 | Biesecker Longacre et al. |

FOREIGN PATENT DOCUMENTS

| | | | |
|---|---|---|---|
| CN | 201901339 | U | 7/2011 |
| DE | 202014103600 | U1 | 8/2014 |
| DE | 102014106507 | A1 | 11/2015 |
| EP | 0212913 | | 3/1987 |
| EP | 317041 | | 5/1989 |
| EP | 348840 | | 1/1990 |
| EP | 363194 | | 11/1990 |
| EP | 0531075 | | 3/1993 |
| EP | 0866111 | | 9/1998 |
| EP | 1645521 | A1 | 4/2006 |
| FR | 1140952 | A | 8/1957 |
| FR | 1238709 | A | 8/1960 |
| FR | 1246918 | | 10/1960 |
| FR | 2620685 | | 3/1989 |
| GB | 2222816 | | 3/1990 |
| JP | S407759 | Y1 | 3/1965 |
| JP | 2002274575 | A | 9/2002 |
| TW | M452154 | U | 5/2013 |
| WO | 9857321 | | 12/1998 |
| WO | 2006125834 | A1 | 11/2006 |

OTHER PUBLICATIONS

Ageless® Product Page, Mitsubishi Gas Chemical America, copyright 2015. Accessed on the Internet Aug. 10, 2015 URL:<http://ageless.mgc-a.com/product/ageless> (2 pages).

Altura Company, Division of Peak Innovations, Inc. Quality Preserved, 6159 Omni Park Drive, Suite B, Mobile, AL 36609; Phone (334) 639-0345; Fax (334) 639-8983; e-mail: peak@mobls.com; "Humi-Pouch"; "Humi-Ship"; "Humi-Box"; patent pending. Cited with respect to U.S. Pat. No. 5,936,178; Dec. 22, 1997 (1 page).

Caribbean Cigar Company of Miami, Florida; "Simple 70 Solution & Humidification"; The Humidification Solution. Cited with respect to U.S. Pat. No. 5,936,178; Dec. 22, 1997 (1 page).

Credo of Marseille, France: "the Tube"; Humidity Regulator for Pocket Humidor. Cited with respect to U.S. Pat. No. 5,936,178; Dec. 22, 1997 (1 page).

DuPont Tyvek for Graphics: Features & Benefits, Dupont USA, p. 1 (Year: 2015).

Deutsch, JC "Ascorbic acid oxidation by hydrogen peroxide", Anal Biochem, Jan. 1, 1998, 255(1): 1-7. Abstract only (1 page).

Esse et al., "Competitive Humidity Control Devices," Seiyge, 6 pages (Dec. 22, 1997).

FreshPax® Oxygen Absorber Product Page, Multisorb Technologies, copyright 2015. Accessed on the Internet Aug. 10, 2015 URL:<http://www.multisorb.com/products-and-systems/freshpax-oygen-absorber-packets-and-strips> (6 pages).

International Search Report and Written Opinion for related PCT Application No. PCT/US2014/015547 mailed May 26, 2014 (10 pages).

International Search Report and Written Opinion for related PCT Application No. PCT/US2016/021496 mailed Jun. 15, 2016 (10 pages).

International Search Report and Written Opinion for related PCT Application PCT/US2017/056341 mailed Feb. 7, 2018 (11 pages).

International Search Report and Written Opinion for related PCT Application PCT/US2017/056394 mailed Jan. 9, 2018 (15 pages).

International Search Report for related PCT Application No. PCT/US98/11968 mailed Sep. 15, 1998 (1 page).

Mechanical and Electrical Products Rust-Proof, Packaging Handbook, Zhang KF et al. Aviation Industry Press, Oct. 31, 1990. https://vpn.hw.sipo/proxy*99148242/n/print.jsp (8 pages).

Owner unknown; "DHS"; Disposable Humidifcation System. Cited with respect to U.S. Pat. No. 5,936,178; Dec. 22, 1997 (1 pages).

PTCA Industries, Inc., P.O. Box 16360 (Office), San Francisco, CA 94116; P.O. Box 250 (Factory), San Carlos, CA 94070; Phone (415) 592 7311; "Humatic 50"; Conditions and maintains up to 50 cigars; U.S. and foreign patents pending. Cited with respect to U.S. Pat. No. 5,936,178; Dec. 22, 1997 (1 page).

StayFresh® SF5CS1500EE-500cc Oxygen Absorbers Product Page, Impak Corporation, copyright 2014. Accessed on the Internet Aug. 10, 2015 URL:<http://www.impakcorporation.com/oxygen_absorbers/SF5CS1500EE> (2 pages).

Tyvek FAQ, DuPont USA, p. 2 (Year: 2013).

Western Humidor Corporation of USA; "Torpedo", Humidifier Portable Humidification System, cited with respect to U.S. Pat. No. 5,936,178; Dec. 22, 1997 (1 page).

* cited by examiner

DEVICE FOR CONTROLLING HEADSPACE HUMIDITY AND METHODS FOR MAKING THE SAME

CROSS-REFERENCE TO RELATED APPLICATIONS

This application claims priority to Provisional Application No. 62/407,269, entitled Device for Controlling Headspace Humidity and Methods for Making the Same, and filed Oct. 12, 2016, the content of which is hereby incorporated by reference herein in its entirety. This application also claims priority to application Ser. No. 15/782,363, entitled Device for Controlling Headspace Humidity and Methods for Making the Same, and filed Oct. 12, 2017, the content of which is also hereby incorporated by reference herein in its entirety.

FIELD OF THE INVENTION

The present disclosure relates to the preservation of substances and objects sensitive to humidity, such as particular foods, pharmaceuticals, and herbs. Particularly, the present disclosure relates to devices for controlling the relative humidity within consumer product packages, and methods for making such devices.

BACKGROUND OF THE INVENTION

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

For many packaged products, including packaged consumer products, it is beneficial to maintain a particular moisture content of the product and/or within the package containing the product. In some cases, the space within a product package that is not taken up by the product itself, may be referred to as the headspace of the packaged product. Some devices are configured to help maintain a consistent relative humidity (RH) of the headspace of packaged products. The RH may be maintained at a level or range deemed optimum for the particular packaged product. It is understood to those skilled in the art that the % RH in the package headspace will result in a % by weight product moisture content, but that the % RH in the headspace and the product % moisture by weight are different values that differ based on the characteristics of the product and its propensity to absorb moisture from the surrounding atmosphere. Many products may be consumed or utilized by a consumer over a period of time, and maintaining a consistent RH may help preserve the life, integrity, freshness, flavor, or other features of the product.

One commonly used device for controlling headspace RH in packaged products is a loose pouch containing a salt solution. As disclosed in U.S. Pat. No. 5,936,178, entitled Humidity Control Device, and filed Jun. 10, 1997, the contents of which are hereby incorporated herein by reference in their entirety, the RH of closed environments can be stabilized by the use of humidity control systems comprised of moisture permeable pouches containing specific salt solutions. However, a growing number of existing and potential customers have indicated that the method of providing the humidity control feature through pouches that are loose in the product package is unsatisfactory, and they refuse to, or are prevented from, using this standard approach for a variety of reasons. For example, consumer confusion may arise as to whether the packet is something other than a humidity control device. In some cases, loose packets may be intentionally or mistakenly discarded by consumers when opening and closing the product packaging, particularly with repeated opening and closing of the packaging over time. Such approaches may also require specialized materials.

Obvious remedies, such as spot gluing pouches to an inside surface of the product package, while easy to implement, have also been deemed by manufacturers or distributors to be unsatisfactory, and in some cases, a product package of that type runs afoul of regulatory requirements for certain products in certain jurisdictions.

Thus, there is a need in the art for a new humidity control device and methods of making such devices. More particularly, there is a need for a humidity control device that may be integral with the product packaging so as to overcome the potential issues associated with loose humidity control packets.

BRIEF SUMMARY OF THE INVENTION

The following presents a simplified summary of one or more embodiments of the present disclosure in order to provide a basic understanding of such embodiments. This summary is not an extensive overview of all contemplated embodiments, and is intended to neither identify key or critical elements of all embodiments, nor delineate the scope of any or all embodiments.

The present disclosure, in one or more embodiments, relates to a humidity control device for controlling headspace relative humidity in a consumer product package.

SUMMARY TO BE COMPLETED AFTER CLAIMS FINALIZED

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

The present disclosure relates to novel and advantageous humidity control devices for consumer products and methods for making the same. Particularly, the present disclosure relates to novel and advantageous humidity control devices, such as packets, pockets, or other shapes or devices, containing a humidity control agent for controlling the relative humidity (RH) within a packaged consumer product, such as a food, pharmaceutical, herb, or any other suitable consumer product. In some embodiments, the humidity controlling device may be attached to, or integrated with, the product packaging. For example, the device may be fixedly or removably adhered to an inside wall of a product package. In some embodiments, the device may be constructed or formed on the product packaging material, such that the device is an integral part of the product packaging material. In other embodiments, the humidity control device may be freely moveable within the product package, or within a portion of the interior of the product package, for example.

A humidity control device of the present disclosure may generally include a humidity control agent, which may be a solid, dispersion, emulsion, gel, or saturated or unsaturated solution, contained within a relatively secure and durable containment. The humidity control device may be configured to create and/or maintain a RH within a product package throughout the life of the product, or at least a portion of the life of the product, including through multiple openings and reclosings of the product package by a consumer. In some embodiments, the humidity control device may generally include two layers of material, such as a base layer and a permeable layer, between which the humidity control agent is sealed. The permeable layer may generally allow gases and/or water vapor to penetrate the device such that the humidity control agent may control humidity of the headspace within a product package. In some embodiments, the base layer of the humidity control device may be fixedly or removably arranged on or adhered to an inner surface of a product package. In other embodiments, the base layer may be or include an inner wall of a product package, such that the permeable layer may generally hold the humidity control agent against the product package material. In other embodiments, the humidity control device may include a different configuration with a humidity control agent arranged within or between one or more layers of material. One or more surfaces of the device may be permeable to gases and/or water vapor such that the humidity control agent may control humidity of the headspace within a product package. The device may be fixedly or removably adhered to an inner surface of a product package, or may be freely placed within a product package.

Figure 1A:
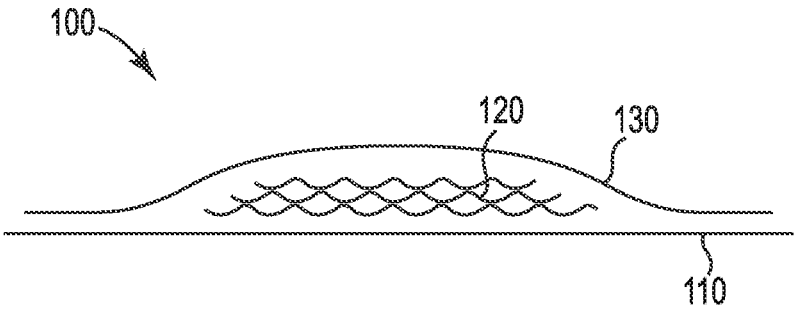
FIG. 1A is a cross sectional view of a humidity control device of the present disclosure, according to one or more embodiments.

Turning now to FIG. 1A, a humidity control device 100 of the present disclosure is shown. As shown, the device 100 may include a humidity control agent 120 arranged between a base layer 110 and a permeable layer 130. The humidity control device 100 may generally have any suitable size and shape configured to be arranged within a product package and to accommodate a desired and effective quantity of a humidity control agent 120. That is, the humidity control device 100 may have any suitable width, length, and thickness, for example. In some embodiments, the humidity control device 100 may have a width of between less than 1 inch and approximately 16 inches. In particular, the humidity control device 100 may have a width of between approximately 0.5 inches and approximately 12 inches. The humidity control device may have a width of less than one inch and approximately 20 inches. In particular, the humidity control device 100 may have a length of between approximately 1 inch and approximately 14 inches. In one embodiment, for example, the humidity control device 100 may have a width of approximately 2 inches and a length of approximately 3 inches. In another embodiments, the humidity control device 100 may have a width of approximately 1 inch and a length of approximately 2 inches. In yet another embodiment, the humidity control device 100 may have a width of approximately 8 inches and a length of approximately 10 inches. In still other embodiments, the humidity control device 100 may have other suitable dimensions configured to provide a desired RH in a product package having a particular size and shape. The humidity control device 100 may have a thickness of between approximately 0.01 inches and approximately 1 inch in some embodiments. In particular, the humidity control device 100 may have a thickness of between approximately 0.025 inches and approximately 0.5 inches, or between 0.05 inches and 0.1 inches. While a rectangular humidity control device 100 is depicted in FIG. 1A, the humidity control device may have any suitable shape and dimensions.

The humidity control agent may be comprised of a solid, a dispersion, an emulsion, a gel, or a saturated or unsaturated aqueous solution comprised of a salt, sugar, polyol such as glycerin or propylene glycol, mannitol, sorbitol, xylitol, amino acid, or other solute modulating the relative humidity. For example, in some embodiments, the humidity control agent may be or include a saturated or unsaturated salt solution, such as those described in U.S. Pat. No. 9,750,811, entitled Devices and Methods for Controlling Headspace Humidity and Oxygen Levels, filed Sep. 15, 2015; U.S. Pat. No. 5,936,178, entitled Humidity Control Device, filed Jun. 10, 1997; and/or U.S. Pat. No. 6,921,026, entitled Preservation of Intermediate Moisture Foods by Controlling Humidity and Inhibition of Mold Growth, filed Feb. 5, 2002, the content of each of which is hereby incorporated herein by reference in its entirety. In other embodiments, other suitable materials for controlling humidity may be used as the humidity control agent 120. The humidity control agent 120 may allow for one-way or two-way humidity control in some embodiments. That is, the humidity control agent 120 may be configured to remove moisture from the air and/or to add moisture to the air. In some embodiments, one or more additives may be combined with the humidity control agent, including but not limited to the additives described in U.S. patent application Ser. No. 14/854,159, U.S. Pat. No. 5,936,178, and/or U.S. Pat. No. 6,921,026. For example, some additives may be used to increase or otherwise control viscosity levels of the humidity control agent. One example of an additives one or more gums for thickening or altering viscosity of the humidity control agent. For example, in some embodiments, between approximately 1% and approximately 3% of the humidity control agent may comprise one or more gums. Other additives may include one or more salts, water, and/or other additives.

The quantity of humidity control agent 120 contained within the humidity control device 100 may vary based on desired RH control capacity, size of product package, and/or other factors. The quantity of humidity control agent 120 may vary from, for example, less than 1 gram to more than 500 grams of material for each humidity control device 100. In some embodiments, the humidity control device 100 may have a quantity of humidity control agent 120 ranging from between approximately 1 gram and approximately 350 grams. In particular embodiments, the quantity of humidity control agent 120 may range between approximately 2 and 8 grams, between approximately 4 and 16 grams, between approximately 57 and 77 grams, or between approximately 300 and 340 grams. In some embodiments, the quantity of humidity control agent 120 may correspond or relate to the quantity of product in the product package, and/or the size of the product package. For example, in some embodiments, the humidity control agent 120 for the humidity control device 100 may be provided in a ratio of between 1:2 and 1:20 to the amount of product in the product package. In particular, the ratio between the amount of humidity control agent 120 and the amount of product in the product package may be between approximately 1:4 and 1:12, or between 1:6 and 1:10. In other embodiments, other ratios of humidity control agent 120 to product in the product package, or to size of product package, may be provided.

It is to be appreciated that the humidity control material 120 may be applied over a "footprint" or a particular area of the base layer. Moreover, the humidity control material 120 may be applied with a desired thickness. It may be advantageous to achieve a workable balance between the footprint of the humidity control agent 120 on the base layer 110, and the thickness of the humidity control agent, in order to achieve a desired level of humidity control and desired size and shape of the humidity control device. Too large a footprint of the humidity control material 120, while reducing humidity control device 100 thickness, may increase width, length, or other dimension(s) of the device and thus require more base layer 110 and permeable layer 130 materials. This may increase material cost for the added permeable material and base material as well as require more product packaging interior space for the humidity control device 100, which may in turn lead to difficulties in forming and/or sealing the packaging. However, a relatively small footprint of the humidity control agent 120, while reducing other dimensions of the humidity control device 100, may lead to a relatively thick humidity control device, and may interfere with forming product packages and filling them.

The base layer 110, as shown in FIG. 1A, may generally be configured to couple or adhere to the permeable layer 130 so as to contain the humidity control agent 120, and may include one or more materials arranged in one or more layers. In some embodiments, the base layer 110 may be substantially impermeable to water vapor and/or gases. The base layer 110 may be rigid, semi-rigid, or flexible. In some embodiments, the base layer 110 may include materials such as, but not limited to, printed or unprinted paper or paperboard-based material, a polyester material such as a heat seal polyester film for example, an oriented film, such as polyester, polypropylene, or nylon, single layer or coextruded layer films made from polyolefins (LDPE, LLDPE, HDPE, PP, copolymers, other variations, or blends thereof), a barrier resin such as EVOH, a barrier material such as thin vapor deposited coatings comprised of, for example, metal(s), metal oxide(s), metalloid(s), metalloid oxide(s), or one or more of a wide range of organic materials. As is known to those of ordinary skill in the art, materials for use as a base layer 110 may be chosen for a variety of properties, including liquid, vapor, or gas barrier, printability, stiffness, sealability, or other properties. In some embodiments, the base layer 110 may be or include generally flexible and/or foldable materials, such as paperboard or foldable plastic. Rigid or semi-rigid substrates with similar material compositions may additionally or alternatively be used as base layer 110 materials.

In some embodiments, the base layer 110 may be configured to fixedly or removably adhere to an inner surface of a product package or a component thereof. For example, the base layer 110 may have an adhesive backing for adhering to an inner wall of a carton, cup, canister, box, pouch, jar, case, bag, or other product package. In some embodiments, the package may be a pouch such as a standup pouch like a gusset pouch, a layflat pouch, or another type of pouch which may optionally include a resealable zipper or other reclosable seal to enclose the interior product compartment. In other embodiments, the base layer 110 may be glued or otherwise adhered to an inner product package surface using any suitable means. In still further embodiments, the base layer 110 may be or include an inner surface of a product package. For example, the base layer 110 may be or include an inner wall of a carton, cup, canister, box, pouch, jar, case, bag, or other product package, such that the permeable layer 130 may hold the humidity control agent 120 directly on or against the product package wall. In one embodiment, the base layer 110 may be or include an inner surface of a paperboard box configured to hold dry food goods, for example, such that the permeable layer 130 may be configured to form a seal with the inner surface of the paperboard box so as to contain the humidity control agent 120 while permitting gas exchange through the permeable layer. In such embodiments where the base layer 110 comprises an inner surface of a product package, the product package itself may be preassembled before receiving the humidity control agent 120 and permeable layer 130, or may be assembled after receiving the humidity control agent and permeable layer.

Figure 1B:
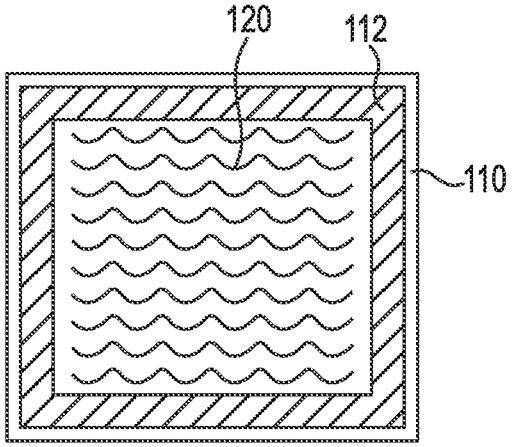
FIG. 1B is a top view of a base layer and humidity control agent of a humidity control device of the present disclosure, according to one or more embodiments.

In some embodiments, the base layer 110 may have an adhesive surface for adhering to the permeable layer 130. For example, the base layer 110 may have a patterned adhesive side—that is, a side having adhesive on select locations or areas—configured to provide an adhesive surface for adhering to the permeable layer 130 without interfering with the humidity control agent 120. FIG. 1B shows an example of a base layer 110 having an adhesive surface 112 providing a perimeter around an area of the base layer configured to receive the humidity control agent 120. As shown, in some embodiments, the adhesive surface 112 may generally form a perimeter or border around the humidity control agent 120, such that the permeable layer 130 may be arranged over the humidity control layer and may bond to the base layer 110 via the adhesive surface, so as to hold the humidity control agent between the two layers. It may be appreciated that the adhesive surface 112 may be arranged in generally any suitable pattern or configuration on the base layer 110 and/or permeable layer 130. In other embodiments, as described further below, other mechanisms may be used additionally or alternatively to adhere the permeable layer 130 to the base layer 110.

The permeable layer 130 may generally be configured to couple or adhere to the base layer 110 so as to contain the humidity control agent 120, and may include one or more materials arranged in one or more layers. The permeable layer 130 may generally be permeable to water vapor and/or oxygen or other gases, allowing water vapor and/or oxygen or other gases to flow through the layer without allowing the humidity control agent 120 to flow through the permeable layer. It may thus be appreciated that the permeable layer 130 may be impermeable to aqueous solutions, such as saturated or unsaturated salt solutions used as a humidity control agent 120 in some embodiments. In other embodiments, for example where the humidity control agent 120 is a gel or a liquid with a relatively high viscosity, the permeable layer 130 may be configured to be impermeable to gels or liquids having a minimum viscosity. The water vapor transport, known as water vapor transmission rate (WVTR) is measured in terms of grams of water passed per 100 square inches of material per 24 hours under standard test conditions. WVTR is generally a function of the type and thickness of materials used. For a humidity control device of the present disclosure, the total moisture transferred may be determined by the area of the permeable layer 130 exposed to a humidity control material in a given application. In some embodiments, for example, a WVTR of about 1-120, or about 5-100, about 10-85, or about 10-60 grams of water per 100 square inches over 24 hours may provide relatively good results for a device in accordance with the invention. In other embodiments, a different WVTR may be used.

Materials that may be employed for the permeable layer 130 may include, but are not limited to, a polymeric film, fibrous polyethylene (TYVEK®) or other non-woven structures, polyesters such as an elastomer, or polyamide Pebax laminated onto a suitable substrate such, but not limited to, as paper. In some embodiments, a thermoplastic polyester elastomer may be used as or with the permeable layer 130. Such thermoplastic polyester elastomer materials may offer a combination of relatively high water vapor permeability, resistance to solutions, such as salt solutions for example, toughness, and the ability to create relatively strong and robust seals with itself. Other materials that may be used as or included with the permeable layer 130 may include, but are not limited to, paper, foil, polyesters, metalized polyesters, copolyesters, polyolefins, copolymers, polyurethanes, polylactic acid, and/or other suitable materials. In some embodiments, the permeable layer 130 may be or include a microperforated material or any other suitable material configured to maintain the humidity control agent 120 at static and/or dynamic pressures encountered during product filling, distribution, storage, and customer use of the packaged product.

Figure 1C:
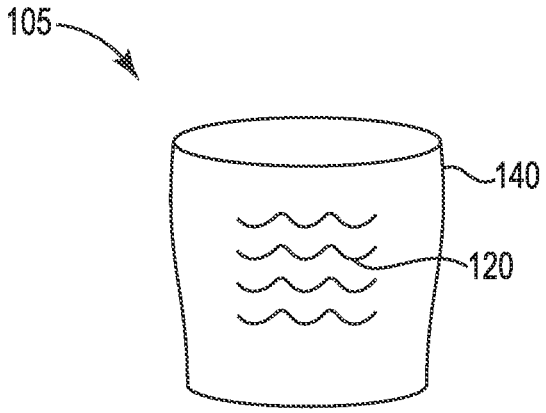
FIG. 1C a side internal view of a humidity control device of the present disclosure, according to one or more embodiments.

Turning now to FIG. 1C, another humidity control device 105 of the present disclosure is shown. In some embodiments, the humidity control device 105 may include a packet or pouch 140 containing a humidity control agent 120. In some embodiments, the humidity control device 105 may be constructed of a piece of material folded and secured to form the pouch 140. An adhesive, heat sealing, and/or other securing mechanisms may be used to seal one or more sides of the pouch 140. The humidity control device 105 may generally have any suitable size and shape configured to be arranged within a product package and to accommodate a desired and effective quantity of a humidity control agent 120. That is, the humidity control device 105 may have any suitable width, length, and thickness, including but not limited to the dimensions described above with respect to the humidity control device 100. While a rectangular humidity control device 105 is depicted in FIG. 1C, the humidity control device may have any suitable shape.

The packet or pouch 140 may comprise any suitable material or materials in any suitable number of layers. In some embodiments, the packet 140 may have one or more sides or faces. For example, as shown in FIG. 1C, the packet may have four sides. In other embodiments, the packet may have two sides, six sides, any other suitable number of sides, or may have, for example, a rounded or curved shape. One or more sides or faces of the packet 140 may be or include an oxygen and/or water vapor permeable material, as described above with respect to the permeable layer 130, such that the humidity control agent 120 may control humidity of the headspace within a product package. In some embodiments, the packet 140 may be mostly or entirely composed of a gas and/or liquid permeable material. That is, for example, a sheet of permeable material may be folded and secured to form the pouch 140. In other embodiments, one or more surfaces or sides of the packet 140 may be generally impermeable to water vapor and/or oxygen or other gases. The one or more sides or faces of the packet 140 may generally be rigid, semi-rigid, or flexible. The one or more sides or faces of the packet 140 may be sealed together using any suitable adhesive or coupling means so as to maintain the humidity control agent 120 within the packet. In some embodiments, the packet 140 may be configured to couple to a product package, such as an inner wall of a product package. For example, one or more surfaces or sides of the packet 140 may have or may be configured to receive an adhesive, such as a heat-activated and/or hot-melt type adhesive in some embodiments.

The packet 140 may generally be configured to control humidity within a product package. In some embodiments, the packet 140 may be configured to be fixedly or removably adhered to an inner surface of a product package. For example, the packet 140 may have an adhesive surface in some embodiments, such that it may be fixedly or removably adhered to an inner wall of a paperboard box, as an example. In other embodiments, the packet 140 may be glued or otherwise adhered to an inner surface of a product package using any suitable means. In other embodiments, the packet 140 may be configured to be loose within a product package, such that it may generally move around within the package.

Figure 1D:
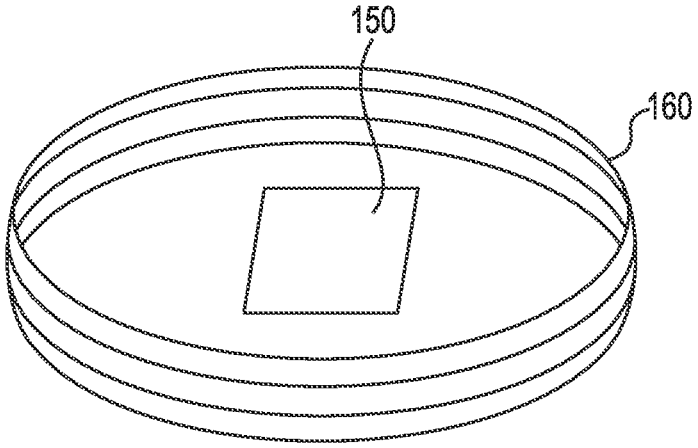
FIG. 1D is a perspective view of a humidity control device of the present disclosure arranged on an inner surface of a product package, according to one or more embodiments.
Figure 1E:
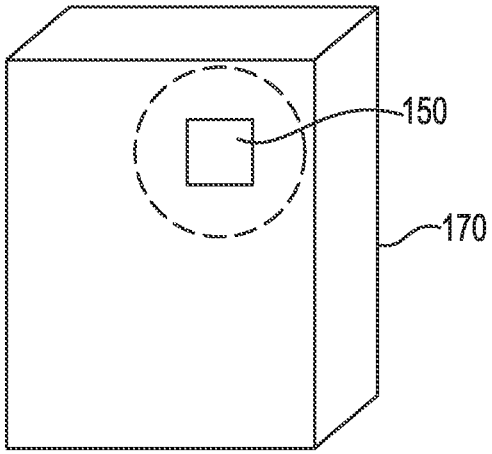
FIG. 1E is a perspective view of a humidity control device of the present disclosure arranged on an inner surface of a product package, according to one or more embodiments.

As described above, a humidity control device of the present disclosure may be adhered to or incorporated on an inner surface of a product package. FIG. 1D shows one example, where a product package may include a jar having a lid 160 and a humidity control device 150 is adhered to an inner surface of the lid. As described above, the humidity control device 150 may be adhered to the lid 160 using any suitable adhesive in some embodiments. In other embodiments, the inner surface of the lid 160 may act as a base layer 110 of the humidity control device 150, such that a permeable layer 130 may maintain a humidity control agent 120 between the permeable layer and lid. FIG. 1E shows another example, where a product package may include a paperboard, cardboard, or other material box 170. The dashed circle of FIG. 1E shows an internal view into the box 170 wherein a humidity control device 150 is adhered to an inner surface of the box. The humidity control device 150 may be adhered to the box 170 using any suitable adhesive in some embodiments. In other embodiments, the inner surface of the box 170 may act as a base layer 110 of the humidity control device 150, such that a permeable layer 130 may maintain a humidity control agent between the permeable layer and box. For example, where the inner surface of the box 170 has a coating, lamination, or other application of a relatively impermeable material, such material may function as a base layer 110. The box 170 may be a product package, or part of a product package, and may be configured to receive a consumer product, such as a food product, tobacco product, or other product. The humidity control device 150 may help to control humidity within the headspace of the box 170.

Figure 1F:
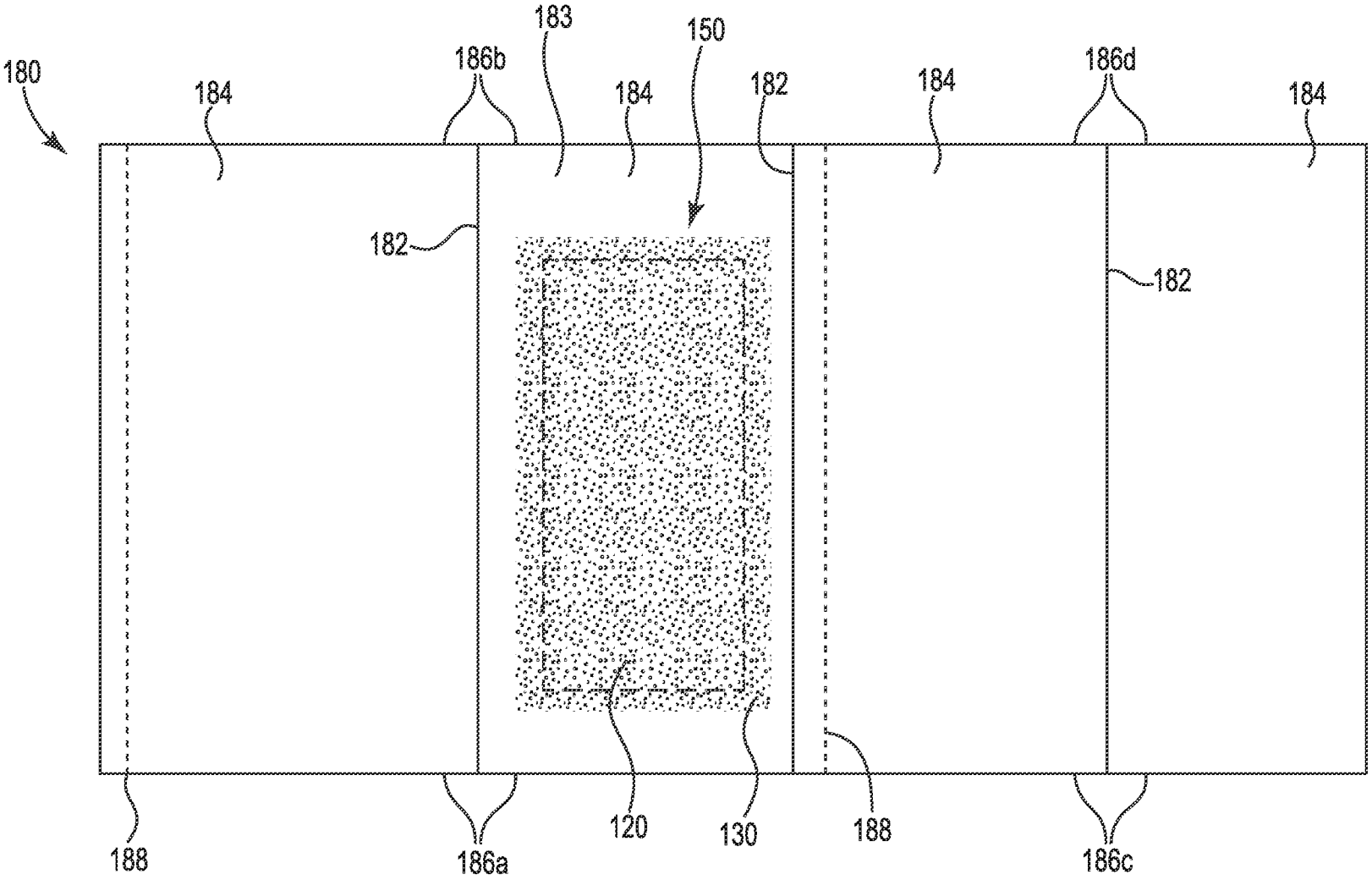
FIG. 1F is a top view of a humidity control device of the present disclosure arranged on an inner surface of another product package, according to one or more embodiments.

FIG. 1F illustrates one example of a pre-assembly product package 180 having a humidity control device 150 arranged thereon. The product package 180 may be a flexible plastic and/or paper pouch, for example. In some embodiments, the product package 180 may comprise a sheet of material configured to be folded into a pouch shape. The sheet of material may have one or more fold lines 182 and one or more panels 184, for example. The material may have a surface 183 configured to be an inner surface of the pouch 180. The material may be configured to be folded at the fold lines 182, and sealed at one or more edges 186, so as to form the pouch shape. In some embodiments, the material may be configured to receive a zip closure 188 or other closure mechanism to facilitate an initial opening of the pouch 180, or alternatively repeated openings and closings of the pouch. The humidity control device 150 may include a humidity control agent 120 and a permeable layer 130 arranged on the pouch 180 material, so as to be arranged on the inner surface 183 of the pouch. In this way, the inner surface 183 of the pouch 180 may operate as a base layer for the humidity control device 150, and may be configured to receive the humidity control agent 120 and the permeable layer 130. In some embodiments, the humidity control agent 120, as described herein, may be deposited directly onto a panel 184, or another portion, of the preassembled pouch 180. In other embodiments, the humidity control agent 120 may be deposited after assembly or partial assembly of the pouch 180. The permeable layer 130 may be arranged over the humidity control agent 120 and may be adhered or fixed to the inner surface 183 of the pouch 180. In some embodiments, as described above, an adhesive, such as a hot melt adhesive, may be used to form a perimeter around the humidity control agent 120 to adhere the permeable layer 130 to the inner surface 183. In this way, the humidity control agent 120 may be maintained between the inner surface 183 and the permeable layer 130. In some embodiments, once the humidity control agent 120 is applied and the permeable layer 130 is adhered, the pouch 180 may be folded, sealed, or otherwise assembled. The pouch may be partially sealed such that it is configured to receive a product, such as but not limited to tobacco, cannabis, a food product, or another product.

Figure 1G:
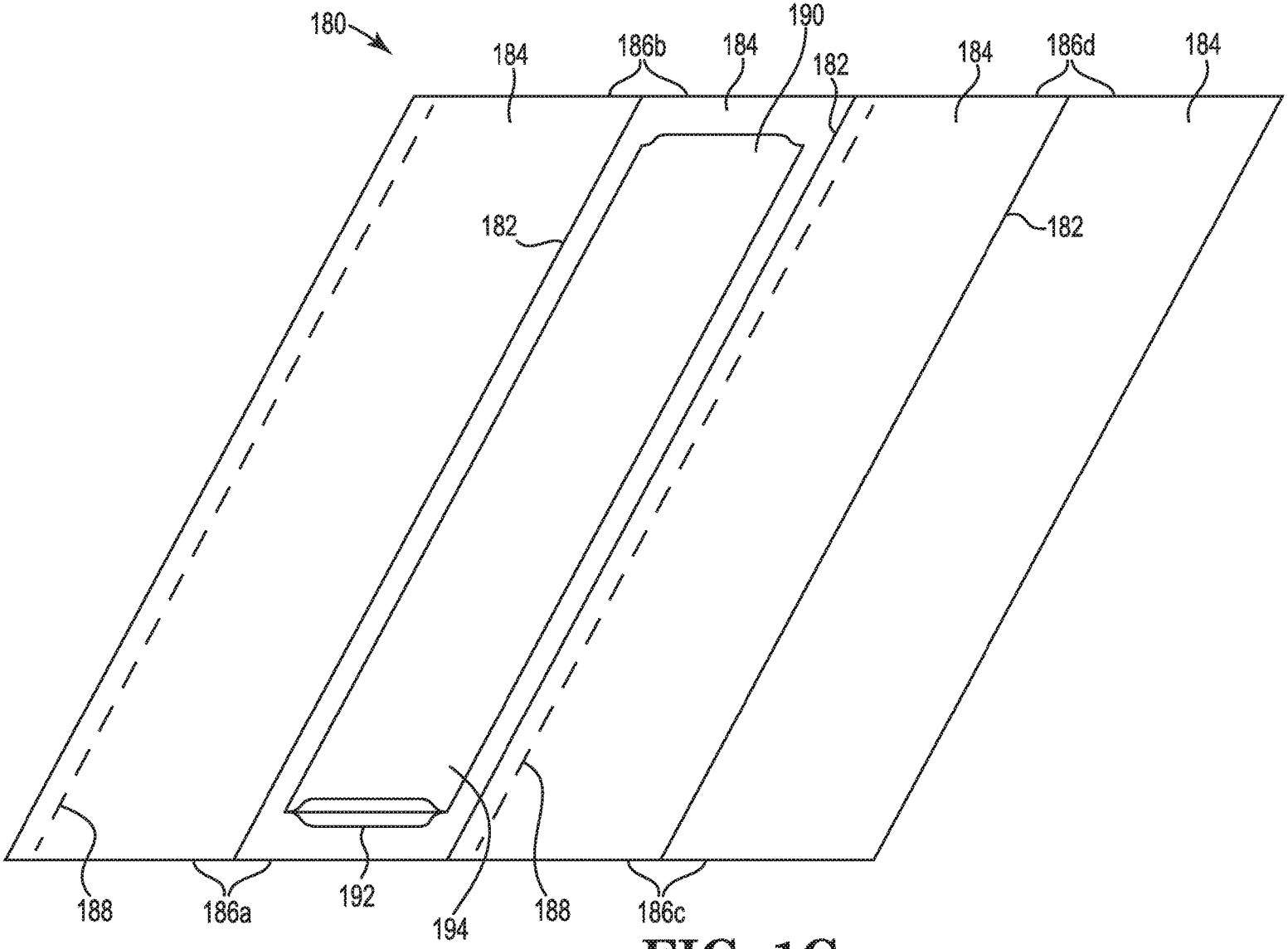
FIG. 1G is a perspective view of a humidity control device of the present disclosure arranged on an inner surface of another product package, according to one or more embodiments.

In an alternative embodiment, a pre-assembly product package 180 of FIG. 1F may include a humidity control package adhered to it as shown in FIG. 1G. The surface of the pre-assembly product package 180 to which the humidity control device 190 is adhered may be configured to be the inner surface of the product compartment of the package after assembly. The humidity control device 190 may be adhered to the pre-assembly product package with its base layer 192 facing and adhering to the pre-assembly product package material and the opposing permeable layer 194 facing outward, such that the permeable surface remains exposed inside the finished product package once complete.

Figure 2A:
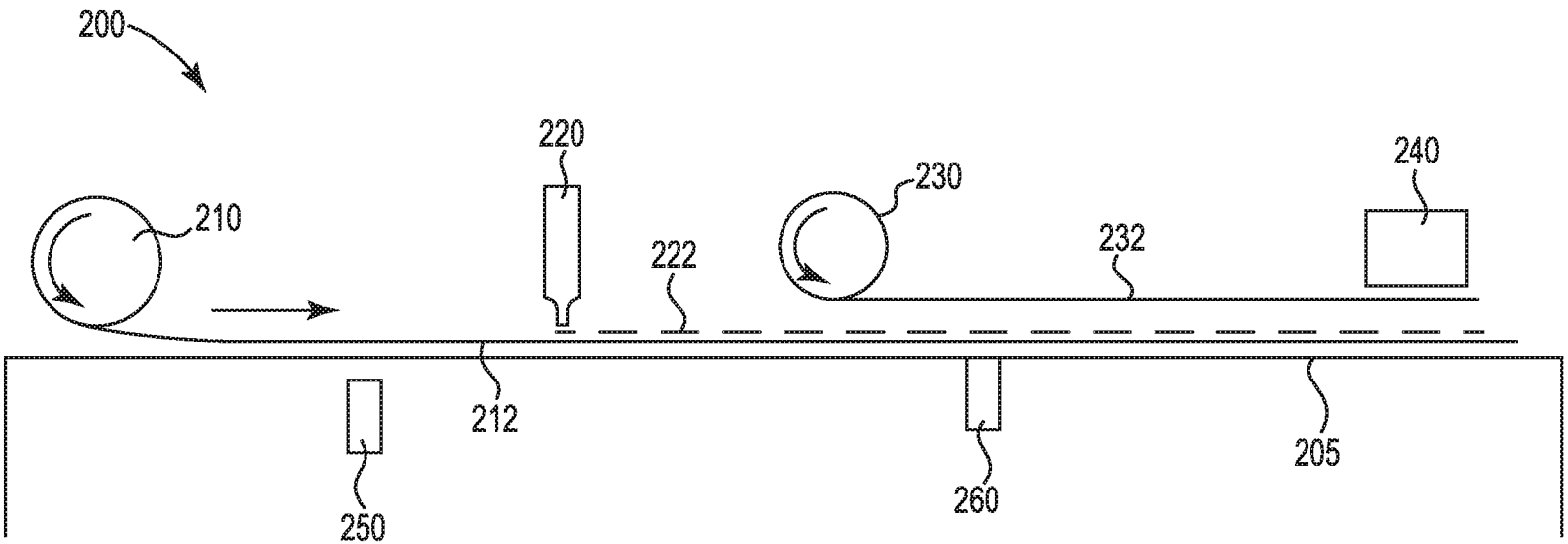
FIG. 2A is a schematic view of a process for manufacturing a humidity control device of the present disclosure, according to one or more embodiments.

Turning now to FIG. 2A, a process 200 for manufacturing one or more humidity control devices of the present disclosure is shown. As shown, the process 200 may generally include applying a humidity control agent 222 and a permeable layer 232 over a base layer 212 arranged on a conveyer belt 205 or other appropriate means of controllably transporting the base layer, such as one or more rollers, drums, air flotation devices, or other means. The process 200 may include unwinding a roll of base material 210 to form a base layer 212 on a conveyer belt 205, extruding or otherwise dispensing a humidity control agent 222 from an extruder 220 or other dispensing device, unwinding a roll of permeable material 230 to form a permeable layer 232, and applying heat from a heater 240 to seal the permeable layer to the base layer. In some embodiments, the process 200 may include using one or more registration devices 250, 260 to sense one or more registration markers. The process 200 may generally provide for the continuous manufacture of a plurality of humidity control devices that may be cut into discrete units that can include pouches, packets, or their precursor structures before, during, or after the operations depicted in FIG. 2A. In some embodiments, the process 200 may include one or more modules to fabricate a variety of packages ready for filling with the intended product. For example, in some embodiments, the process 200 may include folding and partially sealing individual flexible pouches incorporating the humidity control devices of the present disclosure, such as that described above with respect to FIG. 1F, leaving one or more unsealed areas suitable for insertion or filling of product. While the base material and permeable material are described as being on a rolls 210, 230, the materials may generally be in any suitable form, such as sheets or individually pre-cut and/or pre-sized pieces. The conveyer belt 205 or other moving surface may move intermittently or continuously. In some embodiments, a vacuum or other device may operate to hold or pull the base material against the belt 205 or other surface to increase registration precision.

As shown in FIG. 2A, the humidity control agent 222 may be applied in discrete "patches" on the base layer 212 material, each patch surrounded by a perimeter of exposed base layer material. The individual humidity control agent 222 patches may form individual humidity control devices in some embodiments. As described above, the humidity control agent 222 may be a solid, dispersion, emulsion, gel, or saturated or unsaturated solution. In this way, the humidity control agent 222 may be applied to the base layer 212 using different mechanisms based, at least in part, on the medium of the control agent. For example, where the humidity control agent 222 is a solution or other liquid with relatively low viscosity, the base material may have an indented portion configured to receive the humidity control agent, or the base material may have one or more ridges, such as along one or more edges or surrounding an area configured to receive the humidity control agent, so as to contain the humidity control agent in a desired area on the base layer 212. Where the humidity control agent 222 is a solid or gel or other liquid having a relatively high viscosity, the humidity control agent may be simply placed or otherwise applied to the base material without the need for an indentation or ridge(s) in some embodiments. Generally, the humidity control agent 222 may be applied to the base layer 212 using any suitable method. For example, in some embodiments, the humidity control agent 222 may be applied to the base layer 212 via a nozzle assembly having one or more orifices. The agent 222 may be applied in discrete strips, bands, ribbons, or spots of a predetermined quantity and having any suitable size where the agent is viscous, for example. Flow rate of the humidity control agent 222 may be determined by pressure and/or orifice design and size. In some embodiments, the humidity control agent 222 may be applied using a slot orifice dispenser similar to the type used in extrusion of molten polymer or hotmelt-type materials, with the capability of relatively precise control of flow rate and patch length. In other embodiments, the humidity control agent 222 may be applied via screen printing such as, for example, continuous rotary or stop-start flatbed screen printing. Other application techniques, including printing, extruding, painting, or other techniques may be used as well.

As additionally shown in FIG. 2A, the permeable layer 232 may be arranged over the humidity control agent 222 and the base layer 212, thus forming a plurality of discrete humidity control devices. The permeable layer 232 may be applied by various means. For example, in some embodiments, as shown in FIG. 2A, the permeable layer 232 may be applied as a continuous layer across the continuous layer of base material having a plurality of discrete patches of humidity control agent 222. In other embodiments, the permeable layer 232 may be applied in distinct sheets or individually pre-cut and/or pre-sized pieces configured to be arranged over each discrete patch of humidity control agent 222. In some embodiments, the permeable layer 232 may be flexible and may be applied such that it may generally drape over each patch of humidity control agent 222 and onto the exposed upper surface of the base layer 212. The permeable layer 232 may be applied such that the permeable material may contact the base material to form a perimeter around each patch of humidity control agent 222. The permeable material may be applied such that it is in substantially complete and smooth contact with the base layer 212, so as to avoid the presence of channels, folds, or gathers in the permeable layer 232.

In some embodiments, a pocket, bubble, or generally recessed or concave area may be formed in the permeable material before it is placed over the patch of humidity control agent 222 in order to accommodate the humidity control agent 222 and to ensure a smooth contact with the base layer 212 and avoid folds, channels, or gathers. That is, a shallow pocket may be formed in a central region of the permeable material that will directly cover a patch of humidity control agent 222, as shown for example in FIG. 1A. For example, appropriately sized rolls of the permeable material may be fed to a unit that creates the desired pocket in the material and/or cut off individual permeable layer 232 pieces containing pockets for placement over humidity control agent 222 patches. The pocket formation may be done continuously or in intermittent motion; cut off of individual pieces can occur before or after individual pockets are formed; formation done using heat, pressure, matched male/female dies or vacuum into a female die, some combination of one or more of the above, or some other method. The discrete permeable material sections with pockets may then be placed directly over each patch or transferred to another mechanism that places them over each patch. In other embodiments, the permeable layer 232 may be rigid or semi-rigid and may have a recessed area configured to accommodate the thickness of the humidity control agent 222 patch, for example.

When the permeable material is placed over the patch, due to the viscosity of the humidity control agent 222, contact between the permeable material and patch may beneficially aid in temporarily holding the permeable material in place while the perimeter of the permeable layer 232 is sealed or otherwise adhered to the perimeter of the base layer 212.

In some embodiments, one or more registration devices 250, 260 may be configured to sense a registration marker. A registration marker may be, for example, a printed indicator printed on the base layer 212 or permeable layer 232, an indicator on the conveyer belt 205 or another surface, or any other visually or electronically detected cue. A registration device 250, 260 may sense a registration marker to determine a condition related to the process 200. For example, a registration marker may indicate whether the humidity control agent 222 is appropriately positioned on the base layer 212, whether the permeable layer 232 is appropriately positioned on the base layer, whether the permeable layer has properly adhered to the base layer, and/or other elements of the process 200. In some embodiments, the one or more registration devices 250, 260 may produce an electronic signal—or cause an electronic signal to be produced—upon detecting a registration marker. Such signals may result in initiating an automated adjustment to a component of the humidity control device or a component of the process, providing an alert to an operator, halting production, making one or more adjustments, or other actions. In some embodiments, one or more automated or partially automated inspection devices may be incorporated into the process 200 or other processes of the present disclosure, providing a defect detection function to increase consistency and/or quality.

A sealing system 240 may be used to adhere the perimeter of the permeable layer 232 to the exposed perimeter of the base layer 212. For example, the sealing system 240 may include a heater for heat sealing the permeable layer 232 and base layer 212, an ultrasonic welding system, a pressure sealing system, an adhesive application system, and/or other means for bonding the two layers together. In some embodiments, the permeable material and base material may be configured to seal or adhere together, via heat sealing for example. In some embodiments, where the base layer 212 and/or permeable layer 232 are comprised of multiple layers of material(s), one or more of the layers may be sealed or adhered to one or more other layers. In some embodiments, the base layer 212 and/or permeable layer 232 may be pre-treated with, or may include, a bonding material such as an adhesive material or a heat sealable material. In some embodiments, the two materials may be chemically compatible to form heat seals or other seals at particular temperatures, pressure, and/or dwell times. A few examples of such sealant materials are polyethylene and some of its copolymers and ionomers, heat seal coated oriented films such as polypropylene or polyethylene terephthalate, nylon or others polymer types and films. In other embodiments, an adhesive, such as a heat activated adhesive, may be applied to the surface of the base material and/or the perimeter surface of the permeable material that will contact the base material. The adhesive may be applied to an entire surface of the base material and/or permeable material, or may be applied to a perimeter, for example, so as not to interfere with the humidity control agent 222.

In at least one embodiment, a hot-melt type adhesive material may be applied to the base layer 212 in a molten state. The adhesive material may be applied with a suitable temperature and in a suitable amount such that the adhesive material may be configured to retain sufficient heat to bond the permeable layer 232 to the base layer 212. In some embodiments, the adhesive material may be heated to a temperature of between approximately 250 degrees Fahrenheit and approximately 400 degrees Fahrenheit before being applied to the base layer 212. In some embodiments, the adhesive material may be applied on the base layer 212 to form a continuous perimeter or partial perimeter around the humidity control agent 222. In other embodiments, the adhesive material may be applied to the base layer 212 in a plurality of discrete locations, such as in dots. Where the adhesive material is applied at discrete locations, such as in dots, the application temperature and time between application and contact of the permeable layer 232 may be configured such that as the permeable layer is applied, the adhesive material may be configured to remain above its solidification temperature. In this way, when the permeable layer 232 and suitable pressure are applied, the discrete locations or dots may flow together and form a continuous perimeter or partial perimeter that operates to contain the humidity control agent 222 between the base layer 212 and the permeable layer. The hot-melt type adhesive material may be selected to retain a relatively high degree of tackiness, so as to facilitate maintenance of bonding the two layers through distribution and use of the humidity control device.

Generally, any suitable method known in the art may be used to strongly and robustly couple the base layer and permeable layer together, creating strong and robust seals capable of performing satisfactorily through the remaining package formation, filling, closing/sealing operations, as well as distribution, storage, sale, and use by the ultimate consumer.

Figure 7A:
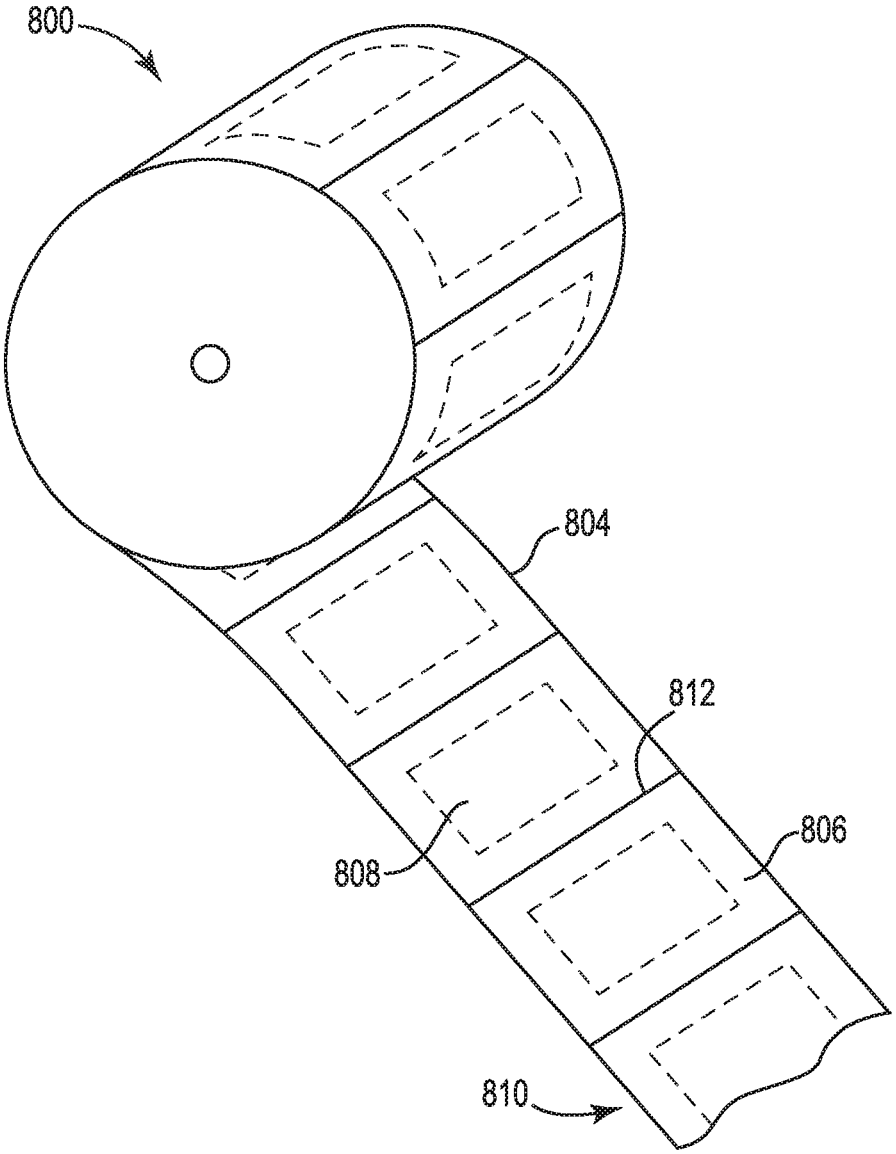
FIG. 7A is a perspective view of a plurality of humidity control devices of the present disclosure arranged in roll, according to one or more embodiments.

When the process 200 is used to manufacture discrete humidity control devices in the form of separate units such pouches or packets, for example, they may be cut apart or otherwise separated from each other before, during, or after the operations depicted in FIG. 2A. Alternatively, the process 200 of FIG. 2A or similar processes may not include a cutting or other separation step to separate the units, or may include a step of only partially cutting the humidity control devices such as along the outer edge only or to form a perforated or semi-cut line, to produce a continuous strip of humidity control devices. An example of a continuous strip of humidity control devices which may be manufactured in this way is depicted in FIG. 7A, in which the strip of humidity control devices is a single row, arranged end to end, shown wound into a roll, as described in more detail later in this disclosure.

Figure 2B:
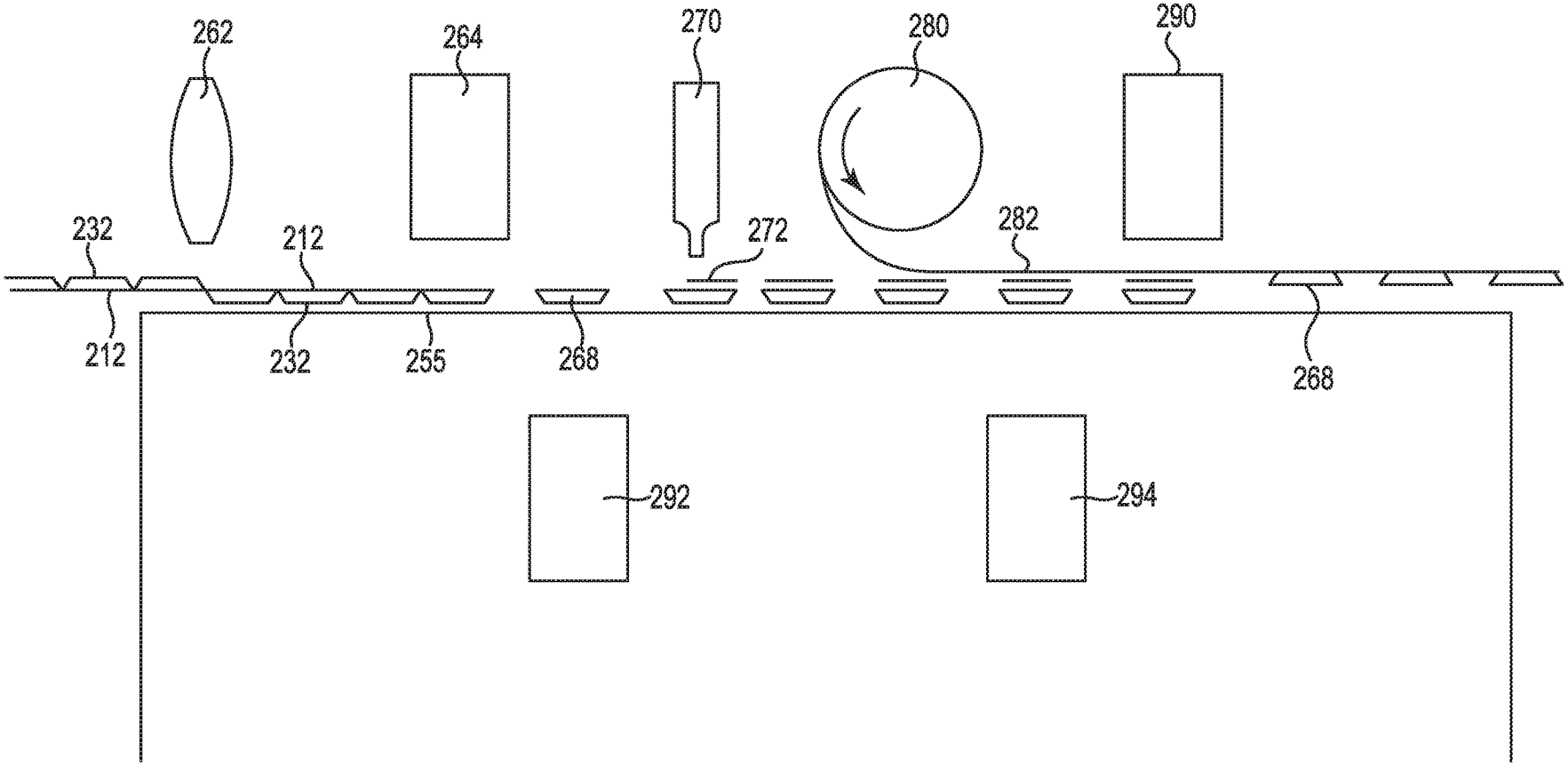
FIG. 2B is a schematic view of a process for manufacturing a humidity control device of the present disclosure, according to one or more embodiments.

In still other embodiments, the process 200 of FIG. 2A or similar processes may be modified to produce a strip of discrete units of individual humidity control devices on a delivery strip such as that shown in FIG. 7A, which is also described further later in this disclosure. For example, after the process 200 shown in FIG. 2A, the sealed humidity control devices may proceed through the process 250 shown in FIG. 2B. While the process 250 of FIG. 2B is depicted as separate from the process 200 of FIG. 2A, it should be understood that the steps of the processes 200 250 may alternatively be performed as one continuous process, and may include a plurality of conveyor belts or transportation systems or a single conveyor belt or transportation system, or the steps may be divided into multiple processes at different separation points. As shown in FIG. 2B, the process 250 includes flipping the sealed humidity control devices produced according to FIG. 2A such that the base layer 212 is oriented upward and the permeable layer 232 is oriented downward using in inverter 262. The process further includes cutting the sealed humidity control devices into discrete humidity control devices 268 using cutter 264 and applying adhesive 272 to the humidity control devices 268 on the base layer 212 outer surface using extruder 270. A roll 280 of delivery strip material may be provided such that the process 250 further includes unrolling the delivery strip 282 in alignment with the humidity control devices 268 and then sealing the humidity control devices 268 to the delivery strip 282 using a sealer 290. The material of the delivery strip 282 and adhesive 272 may be selected to allow for temporary adhesion of the humidity control device 268 to the delivery strip 282. In this way, the humidity control devices 268 may be removed from the delivery strip 282 during subsequent manufacturing processes, like during the adhesion of the humidity control devices to the interior of a product package during product package manufacture, as in the process shown in FIG. 8B, described later in this disclosure, for example. The process 250 may include one more registration devices 292 294 which may be like those described previously above. It should be understood that the steps of the process may be performed in a different order than that shown above and/or one or more steps may be omitted. For example, the step of cutting the humidity control devices 268 may be performed after applying the adhesive, or may be deferred until later in the manufacturing process such as immediately prior to, during, or after application of the humidity control device 268 to a product package.

Figure 4:
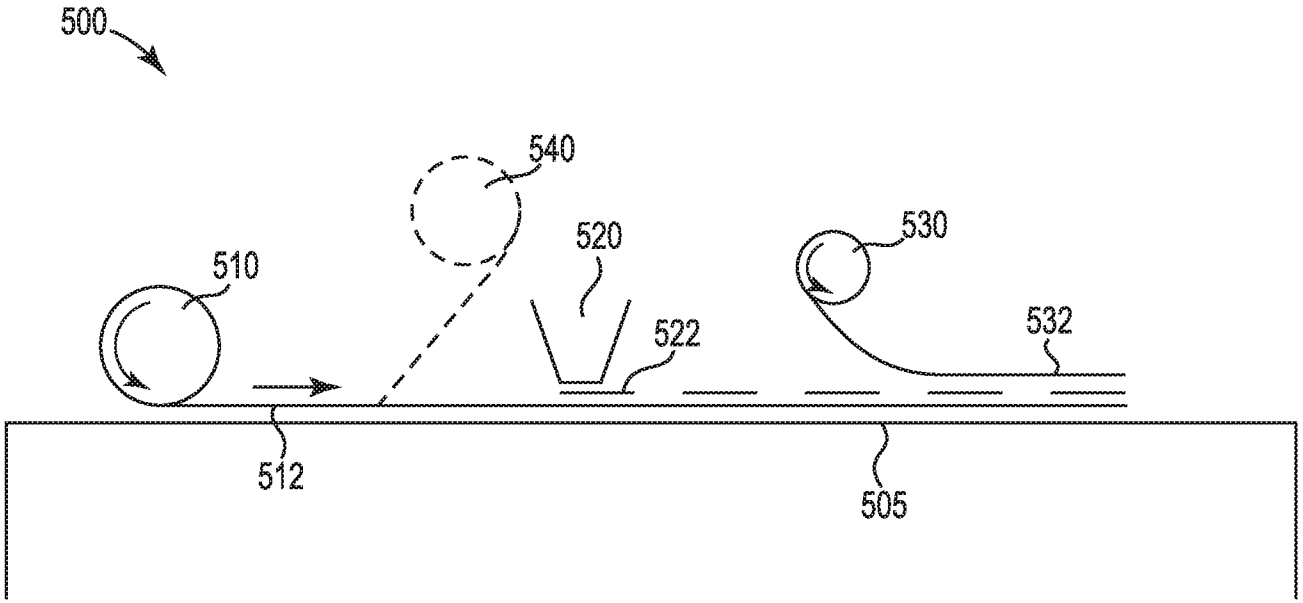
FIG. 4 is a schematic view of another process for manufacturing a humidity control device of the present disclosure, according to one or more embodiments.

For example, turning to FIG. 4, in some embodiments, the base layer may be or include an adhesive layer having a pre-applied adhesive configured to bond to the permeable layer. As shown in FIG. 4, the base layer material 510 may have an adhesive surface on the side configured to couple to the permeable layer 532. The adhesive surface may cover an entire side of the base layer 512 or may be arranged in particular areas, such as lining a perimeter of where the humidity control agent 522 is configured to be arranged, as described above with respect to FIG. 1B. In some embodiments, a protective layer 540 may be peeled back from the base layer 512 before the humidity control agent 522 is applied to the base layer. The protective layer 540 may be a layer of material arranged over the adhesive of the base layer material, so as to protect the adhesive surface prior to use. The protective layer 540 may be comprised of a paper material or other suitable material configured to release from the adhesive layer or surface of the base layer 512 without tearing or otherwise being damaged so as to facilitate relatively smooth and event movement of the base layer through the process, for example. In embodiments where the adhesive material is applied to the base layer 512 in particular patterned areas, the protective layer 540 may cover only those patterned adhesive portions of the base layer 512 and thus may be peeled or otherwise removed from the base layer during or after application of the humidity control agent 522.

Figure 3:
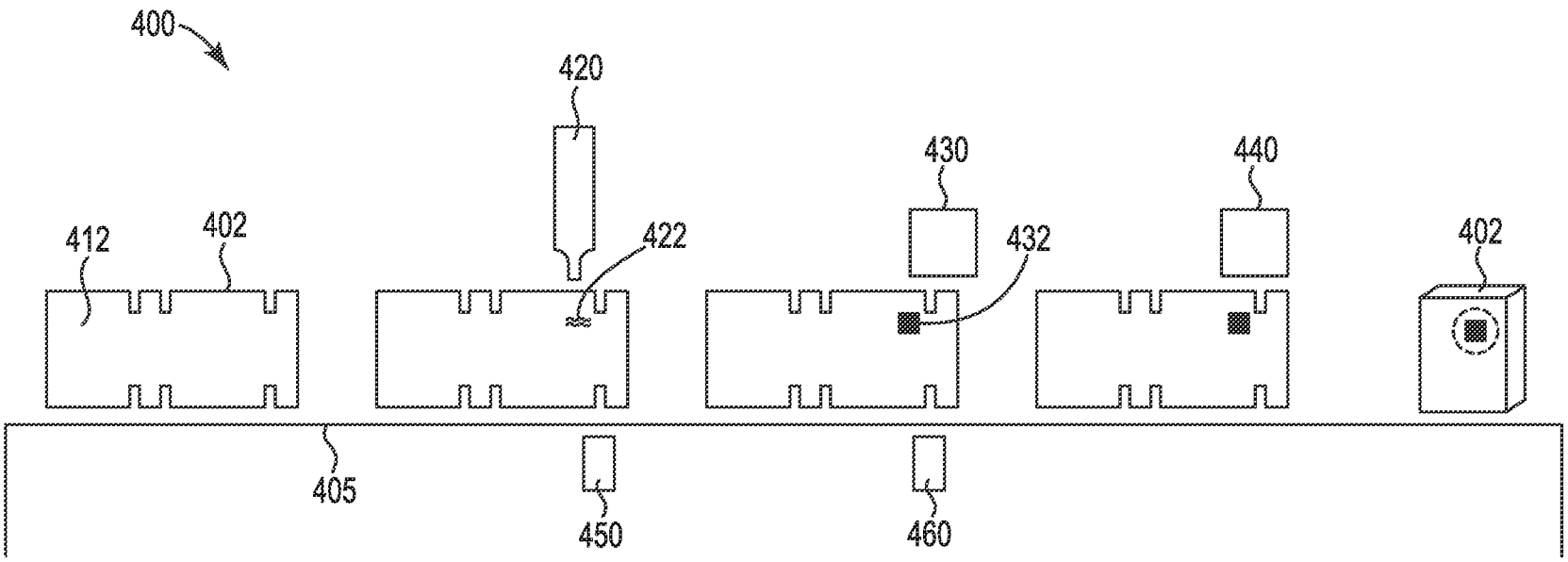
FIG. 3 is a schematic view of a process for manufacturing a humidity control device of the present disclosure, according to one or more embodiments.

As described above, in some embodiments, the base layer of a humidity control device of the present disclosure may be or include a product packaging material, such that the humidity control device may be constructed directly on a material that will ultimately be an inner surface of a product package. As shown for example in FIG. 3, the base layer 412 may be or include a box, such as a paperboard or cardboard box, or a portion thereof, which may be arranged on a conveyer belt 405 or other moving or stationary carrier in an unfolded or otherwise flattened configuration. The humidity control device process 400 may include applying a humidity control agent 422 and permeable layer 432 directly to a surface of the unfolded or flattened box 402, such as a surface that will become an inner surface of the box once it is folded and/or assembled. The humidity control agent 422 may be applied using an extruder 420 or other dispensing device. The permeable layer 432 may be applied by a device 430 configured to cut and/or position the permeable material over the humidity control agent 422 and box 402. The permeable material may then be heat sealed to the box 402 using a heater 440 in some embodiments. In other embodiments, the permeable material may be sealed to the box 402 using a different sealing or coupling means, as described above.

Figure 5:
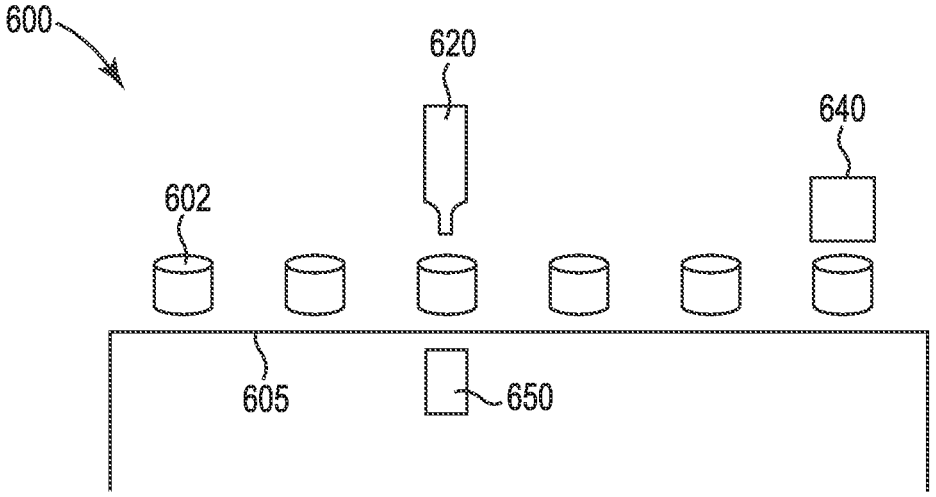
FIG. 5 is a schematic view of a process for manufacturing a humidity control device of the present disclosure, according to one or more embodiments.

Turning now to FIG. 5, as described above, a humidity control device of the present disclosure may comprise a packet 602 containing a humidity control agent. FIG. 5 illustrates a process 600 for adding a quantity of humidity control agent to the packet 602 and sealing the packet. As shown, a plurality of packets 602 may be arranged on a conveyer belt 605 or other moving or stationary surface. An extruder 620 or other device may operate to inject a quantity of humidity control agent into each packet. A heater 640 may operably seal two sides or faces of the packet 602 together after the humidity control agent is injected. In other embodiments, other mechanism(s) may be used to close or seal the packet 602, such as those sealing methods described above. One or more registration devices 650 may assist the process 600, as described above.

A humidity control device of the present disclosure may generally be constructed of materials that not only allow relatively high permeability of water vapor through at least a portion of the containment, but also are sufficiently tough to resist abuse that may otherwise result in the containment rupturing and contaminating the product with the humidity control agent. The humidity control devices of the present disclosure may additionally be constructed economically, such that the devices may be applied to a wide variety of product packaging. The humidity control devices described herein may additionally meet applicable performance standards and requirements.

Figure 6:
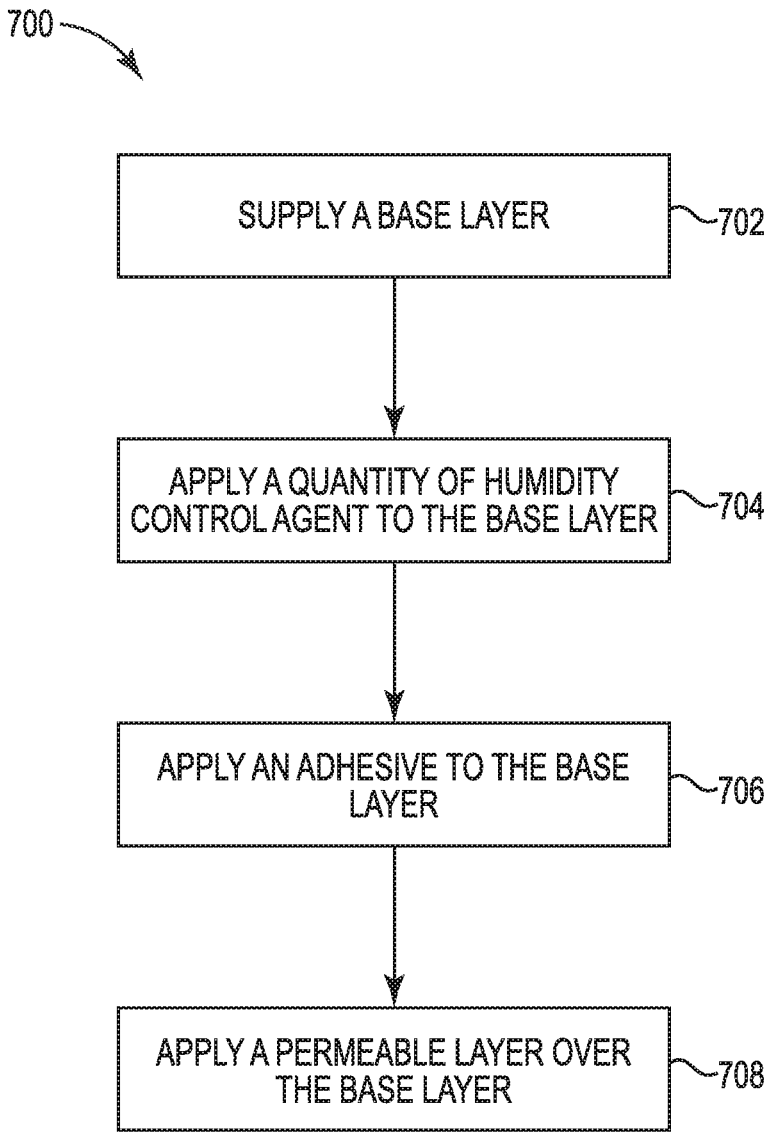
FIG. 6 is a flow diagram of a method of manufacturing a humidity control device of the present disclosure, according to one or more embodiments.

As generally described above, and as shown in FIG. 6, a method 700 of manufacturing a humidity control device of the present disclosure may include the steps of supplying a base layer 702; applying a quantity of a humidity control agent to the base layer 704; applying an adhesive to the base layer 706; and applying a permeable layer over the base layer 708. It is to be appreciated that the steps may be performed in generally any suitable order. That is, for example, the adhesive material may be applied to the base layer before or after the humidity control agent is applied. In some embodiments, the method 700 may include additional and/or alternative steps. For example, pressure may be applied to the permeable layer to help it adhere to the base layer via the adhesive.

In some embodiments, humidity control devices including a base layer, a permeable layer, and a humidity control material contained between the base layer and the permeable layer, may be provided in a continuous roll for use in assembly of product packages including the humidity control devices. In FIG. 7A, a roll 800 of humidity control devices 804 is shown with the humidity control device 804 connected in a linear fashion at their edges along separation line 812, which may optionally be perforated or scored or may be intact. The humidity control devices 804 may be separated from each other along separation line 812 at a later step, such as during assembly of the product package, such as by tearing or cutting at separation line 812. In the example shown, the base layer 806 faces inward while the permeable layer 810 is unseen and faces outward. However, the roll 802 could alternatively be configured with the permeable layer 806 facing outward and the base layer 810 facing inward. The choice of orientation may be selected based upon how the roll 802 is used during assembly of the product package with which it is used, for example. In alternative embodiments, the continuous interconnected line of humidity control devices as shown in this figure may be provided in a different configuration rather than a roll. For example, the humidity control devices may be stacked by folding, such as by folding between each humidity control device. In some embodiments, the humidity control devices may be folded back and forth between each humidity control device in a zig zag fan fashion.

Figure 7B:
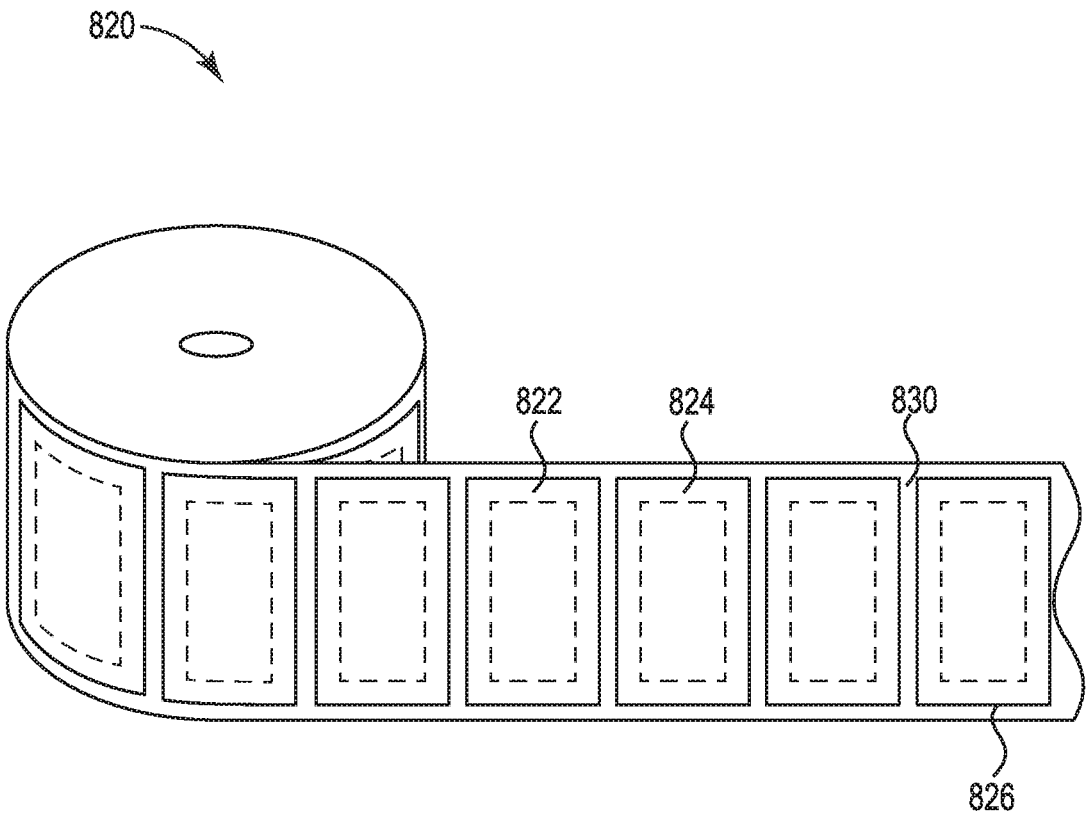
FIG. 7B is a perspective view of a plurality of humidity control devices of the present disclosure arranged in roll, according to one or more embodiments.

Another example is shown in FIG. 7B, in which a roll 820 provides a plurality of discrete humidity control devices 824 removably adhered to a delivery strip 830. The permeable layer 824 is exposed and faces outward on the outside surface of the delivery strip 830 while the base layer 826 is unseen and faces inward against the delivery strip 830. The roll could alternatively be configured with the humidity control devices 824 on the inside surface of the delivery strip 830 facing inward. The choice of orientation may be selected based upon how the roll 820 is used during assembly of the product package, for example. In this example, the humidity control devices 824 are oriented in a linear fashion, end to end, but are spaced apart and not connected. Because of this, they may be removed from the delivery strip 830 such as by peeling or pulling them off of the delivery strip 830 with no subsequent step of separation or cutting needed between the humidity control devices. As described with regard to the continuous interconnected humidity control devices 804 above, the discrete humidity control devices 824 on the delivery strip 830 may likewise be provided in different configurations other than a roll. For example, the humidity control devices may be stacked by folding, such as by folding between each humidity control device. In some embodiments, the delivery strip 830 may be folded between the humidity control devices 824, such as between each humidity control device, and may be folded in a zig zag fan fashion.

The rolls or stacks of humidity control devices (or other delivery configurations) may be used in processes of assembling product packages to supply humidity control devices to the interior spaces of the product package, where the product will be stored. The humidity control devices may be supplied as loose items within the product packages or may be removably or permanently adhered to an interior surface of the product packages.

Figure 8A:
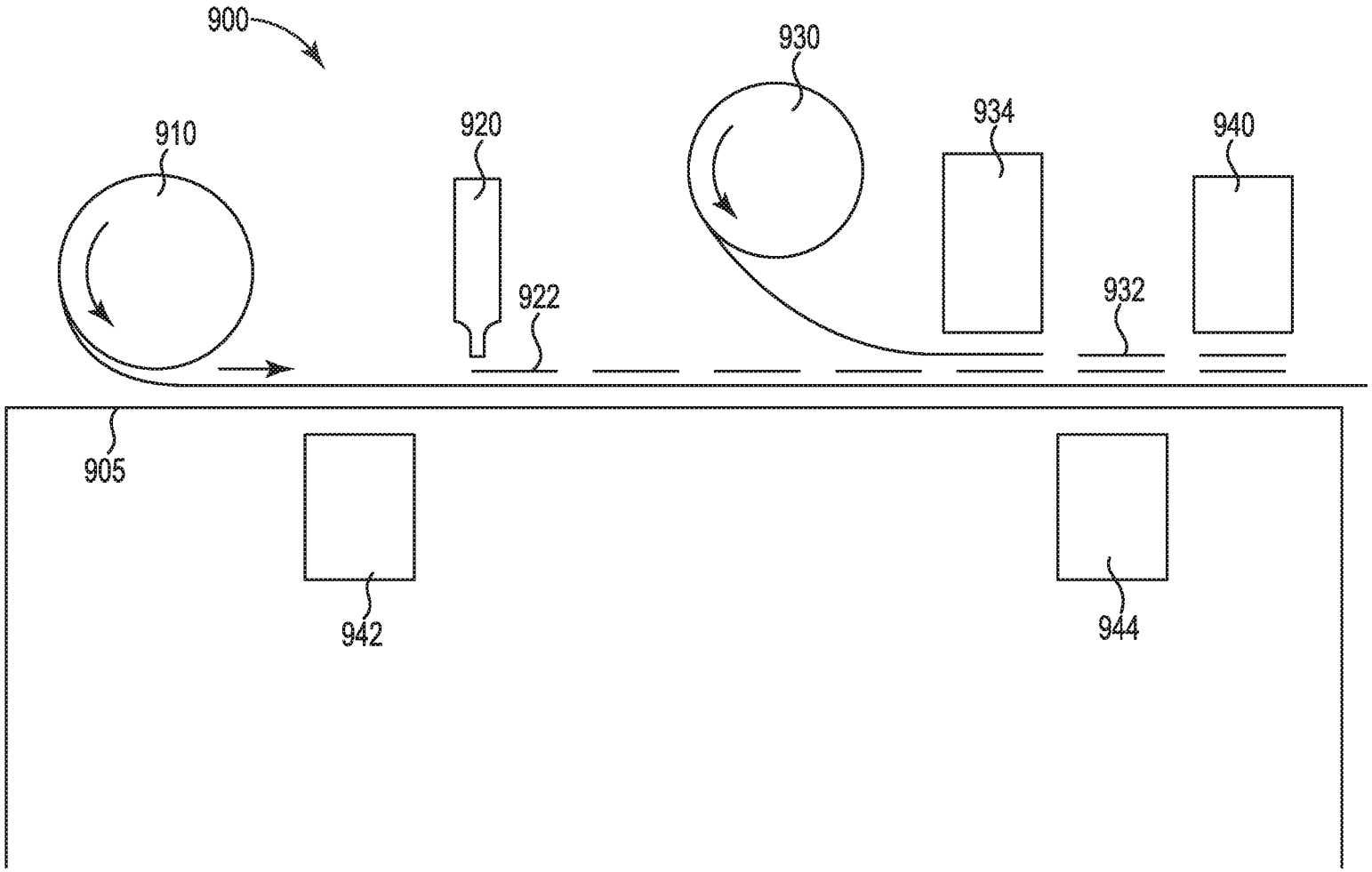
FIG. 8A is a schematic view of a process for manufacturing a pre-product package including a humidity control device of the present disclosure, according to one or more embodiments.

An example of a process by which a roll of humidity control devices may be used in the process of assembling a package, or may be added to packing material prior to being assembled into a package, is shown in FIG. 8A. The process 900 for manufacturing a product package is shown using a roll 980 of humidity control devices 982 like roll 800 shown in FIG. 7A. The process 900 may generally include applying a humidity control device 932 to a package material layer 912 on a conveyer belt 905 or other appropriate means of controllably transporting the package layer, such as one or more rollers, drums, air flotation devices, or other means. The process 900 may including unwinding a roll of package material 910 to form a package material layer 912 on a conveyor bels 905, extruding or otherwise applying or dispensing an adhesive 922 from an extruder 920 or other dispensing device, unwinding a roll 930 of humidity control devices 932 (or unfolding a stack of humidity control devices, depending upon their configuration) with the humidity control device aligned with the adhesive 912, and separating the humidity control devices 982 from the continuous row of humidity control devices. The process may further include sealing the humidity control devices 934 to the packing material layer 910 using sealing system 940, the nature of the sealing system depending upon the type of adhesive used. For example, if the adhesive is heat activated, the sealing system 940 may include a heater, though other adhesives and/or sealing systems may alternatively be used as described above with regard to sealing systems, such as a hot-melt adhesive applied in a molten state. In some embodiments, the process 900 may include using one or more registration devices 942, 944 to sense one or more registration markers.

Figure 8B:
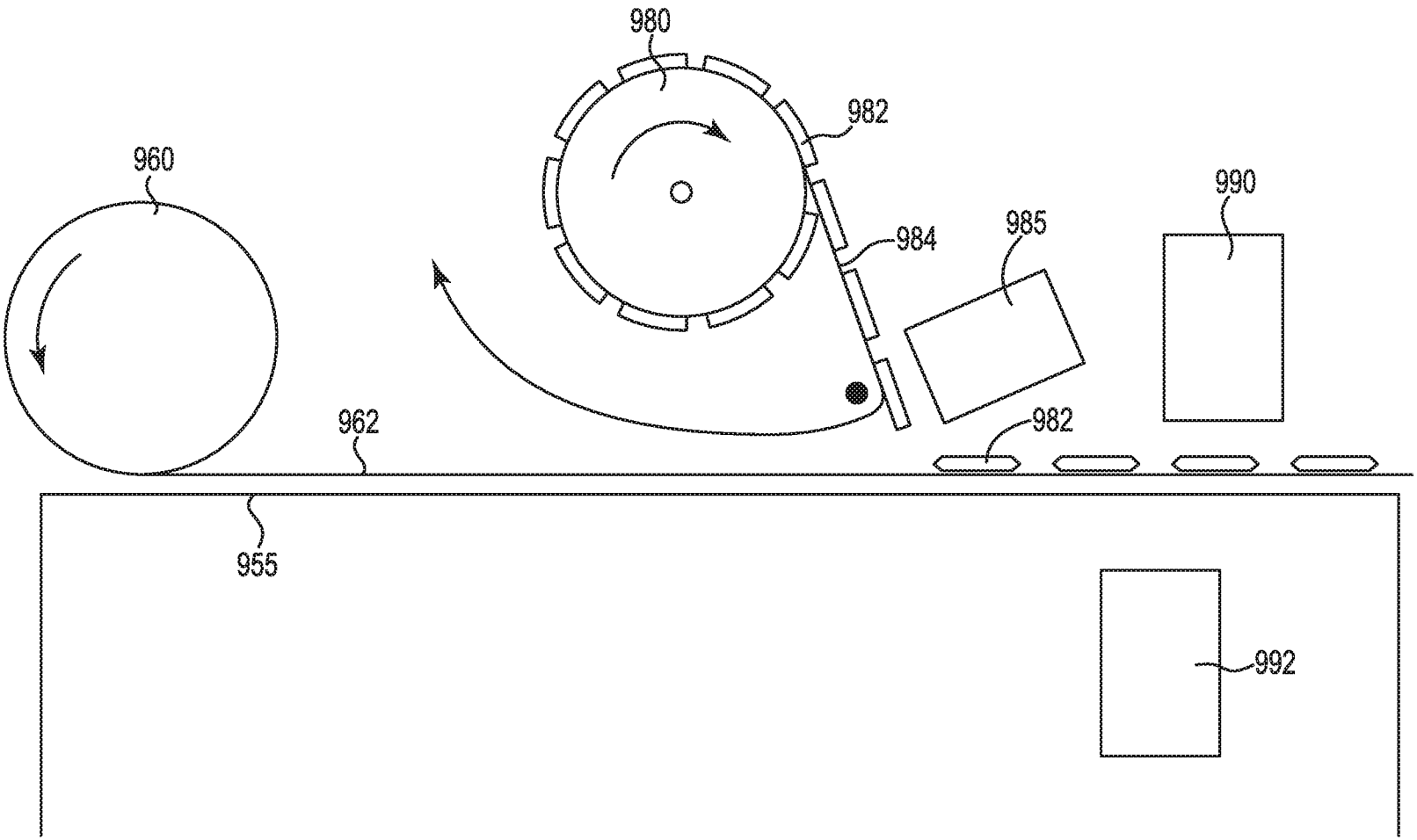
FIG. 8B is a schematic view of a process for manufacturing a pre-product package including a humidity control device of the present disclosure, according to one or more embodiments.

Another example of a process by which a roll of humidity control devices may be used in the process of assembling a package is shown in FIG. 8B. The process 90 for manufacturing a product package is shown using a roll 980 of humidity control devices 982 on a delivery strip 984, such as the roll 820 of FIG. 7B. Alternatively the humidity control devices 982 on the delivery strip 984 may be configured in a folded fashion as described above. By whatever method they are configured, they may be supplied (unwound, unfolded, etc) to the process in a continuous manner. The process 950 may generally include applying a humidity control device 982 to a package material layer 962 on a conveyer belt 955 or other appropriate means of controllably transporting the package layer. As shown, the process includes supplying a continuous strip of humidity control devices 982 adhered to a delivery strip 984, which in this example includes unwinding a roll 980 of humidity control devices 982. The process further includes removing the humidity control devices 982 from the delivery strip 986 using a separating system 985 such as a peeler. The humidity control devices 982 may be separated from the delivery strip 984 with the adhesive (which held the humidity control device 982 to the delivery strip 984) still adhering to the base layer of the humidity control device 982. The separated humidity control device 982 may then be placed onto the packing material layer 962 with the base layer including the adhesive facing downward, against the packing material layer 962. The placement may be performed by a device or by gravity, as the humidity control device 982 is released from the delivery strip 984, for example. The humidity control device 982 may adhere to the packing material layer 984 using the same adhesive which previously held the humidity control device 984 on the delivery strip 984, without the application of additional adhesive. In some embodiments, the adhesive may be sufficient to adhere the humidity control device 982 to the packing material layer 962 with no addition steps. However, in other embodiments, such as the embodiment shown in FIG. 8B, the process may further include sealing the humidity control device 982 to the packing material layer 962 using sealing system 990, the particular sealing system depending upon the type of adhesive used. In some embodiments, one or more of the the step of peeling the humidity control device 982 from the delivery layer 984, placing the humidity control device 982 on the packing material 962, and/or sealing the humidity control device 982 to the packing material layer 962 may be combined and performed using a single device. In some embodiments, the process 900 may include using one or more registration devices such as registration device 942 to sense one or more registration markers.

In each of examples 8A and 8B, the choice of adhesive 922 972 may be compatible with the product to be supplied within the package. For example, if the package is for use with food products or other consumables such as tobacco or cannabis products, a food grade adhesive may be used. Furthermore, an adhesive may be selected which is sufficiently strong to maintain attachment of the humidity control device 932 982 to the package layer 912 962 throughout package production, filling, transportation, and end use by a consumer, for example. In addition, the choice of sealing system 940 990 used may depend upon the type of adhesive 922 972 and how it is applied (such as pattern of delivery (sheet, line, dots, etc.), temperature, etc.). For example, if the adhesive is heat activated, the sealing system may include a heater, though other adhesives and/or sealing systems may alternatively be used as described above such as a hot melt adhesive applied in a molten state with a sealing system providing pressure.

It should further be understood that in each of examples 8A and 8B and in other variations, the package material layer 912 962 with adhered humidity control devices 932 972 may continue directly, such as further along the conveyor system, or indirectly, to the folding, cutting, sealing and/or other steps of forming the package material layer 912 962 into a package component such as a package lid or a final finished package. In some embodiments, one or more steps of the manufacture of the package such as folding, cutting, sealing of the package material layer and/or other steps may occur prior to the adhesion of the humidity control device 932 972 the package material layer 912 962. The package material layer 912 962 may be formed into pouches, packets, or other complete or precursor package structures before, during, or after the operations depicted in FIGS. 8A and 8B. In some embodiments, the process 900 950 may further include folding and/or adhering or sealing portions of the pre-package material layer 912 962 to itself and separating the prepackage material into separate pieces such as by cutting the pre-package material layer 912 962 into complete or partially complete portions of packages or complete packages, such as individual flexible pouches incorporating the humidity control devices of the present disclosure, leaving one or more unsealed areas suitable for insertion or filling of product. In the various processes described herein, the conveyer belt 905 955 or other moving surface may move intermittently or continuously. In some embodiments, a vacuum or other device may operate to hold or pull the package material layer 912 962 the belt 905 955 or other surface to increase registration precision. The final package may include the humidity control devices adhered to the package within the interior space of the package into which the product will be inserted.

The processes described with regard to FIGS. 8A and 8B include a roll of pre-packaging material which forms the package material layer, but it should be understood that the same or similar processes may be used with other pre-packaging, partially finished, or finished packaging materials. For example, rather than beginning with rolls 910 950 the processes may begin with other package materials which may or may not be in the form of a roll. For example, the package material may be a box material, such as a paperboard or cardboard box, or a portion thereof, such as the base layer 412 shown in FIG. 3. In other examples, the package material may be a portion of the package like lid to a package, such as lid 160 shown in FIG. 1D.

While the processes described with regard to FIGS. 8A and 8B include the application of an adhesive 922 972 from and extruder 920 970, the adhesive may alternatively be applied to the pre-packaging material 910 960 by other methods than an extruder, with the type of application method selected depending upon preference and the nature of the selected adhesive. Furthermore, while the adhesive 922 972 is applied to the pre-packaging material 910 960 in the processes as shown in these examples, the same adhesive 922 972 and/or a different adhesive could alternatively or additionally be applied to the humidity control devices 932, 982 prior to adhering them to the pre-packaging material 910 960 using an extruder or other adhesive application device. In still other alternative embodiments, the pre-packaging material and/or the humidity control devices may already include an adhesive prior to unrolling. For example, the pre-packaging material may have adhesive present on the interior surface at the target location for placement of the humidity control devices after unrolling the pre-packaging material. Alternatively or additionally, the humidity control devices may have adhesive present on their surfaces, such as on the exterior surface of the humidity control devices opposite the delivery strip. When the adhesive is already present on the pre-packaging material and/or the humidity control device rolls, the adhesive may be covered by a protective layer akin to protective layer 540 described above with regard to FIG. 4, which may be removed such as by peeling off prior to placing the humidity control devices on the packing material and adhering them together.

EXAMPLE

In one particular example, a humidity control device was formed with a base layer, a humidity control material, and a permeable layer. A base layer of material was constructed with oriented polypropylene having a thickness of 0.00075 inches, metallized polyester having a thickness of 0.0005 inches, and polyethylene having a thickness of 0.0025 inch. Approximately eight grams of a humidity control material, in the form of a gel, was applied to approximately a 2-3 inch area of the base layer. A pressure sensitive hot melt adhesive was deposited on the base layer in a perimeter around the humidity control material. The adhesive was applied with a thickness or depth of approximately 0.075 inches. While the adhesive material was still relatively hot and molten, the permeable layer was positioned over the humidity control material and the adhesive so as to bond to the base layer via the adhesive. The permeable layer was a cast nylon film with a thickness of approximately 0.001 inches. The humidity control device was subject to various stresses, including physical manipulation, exposure to temperatures of at least 110 degrees Fahrenheit, and shipment across 500 miles via the United States Postal Services. Despite these various stresses, the base layer and permeable layer remained bonded to one another, and the gel remained in place between the two layers.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an element may still actually contain such element as long as there is generally no significant effect thereof.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

We claim:

1. A method of producing a humidity controlled product package, the method comprising:

providing a pre-package material having an interior surface;

providing a stack comprising:

a plurality of individual humidity control devices, each humidity control device comprising:

a base layer;

a permeable layer comprising a material permeable to water vapor, the permeable layer including one or more registration markers, the permeable layer also including a concave area inside the one or more registration markers, the permeable layer coupled to the base layer; and a humidity control agent arranged between the base layer and the concave area between the one or more registration markers of the permeable layer;

a delivery strip, and an adhesive holding the humidity control devices on the delivery strip;

separating an individual humidity control device from the delivery strip while leaving the delivery strip intact;

adhering the separated individual humidity control device to the interior surface of the pre-package material; and after adhering the separated individual humidity control device to the interior surface of the product package material, forming the pre-package material into a product package having product compartment such that the humidity control device is adhered to an interior surface of the product package within the product compartment.

2. The method of claim 1 wherein separating an individual humidity control device from the delivery strip comprises removing an individual humidity control device from the delivery strip with the adhesive remaining on the separated individual humidity control device.

3. The method of claim 2 wherein the step of adhering the separated individual humidity control device to the interior surface of the pre-package material comprises adhering the humidity control device to the pre-package material using the adhesive on the separated individual humidity control device.

4. The method of claim 1 wherein providing a pre-package material having an interior surface comprises providing a roll of pre-package material having an interior surface, further comprising unrolling the roll of pre-package material to expose the interior surface on a conveyor system.

5. The method of claim 1 wherein the product package comprises a bag or pouch.

6. The method of claim 1 wherein the step of separating an individual humidity control device from the delivery strip comprises peeling the individual humidity control device off of the delivery strip.

7. The method of claim 1 wherein the adhesive holds the humidity control device on the delivery strip with the base layer facing the delivery strip.

* * * * *